US012419442B2

(12) United States Patent
Kim et al.

(10) Patent No.: US 12,419,442 B2
(45) Date of Patent: Sep. 23, 2025

(54) SHOW CASE

(71) Applicant: LG ELECTRONICS INC., Seoul (KR)

(72) Inventors: Ye Jin Kim, Seoul (KR); Hong Seung Do, Seoul (KR); Myoung Suk Kim, Seoul (KR); Byeong Jin Kim, Daejeon (KR); Hyeon Jeong Suk, Daejeon (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/833,436

(22) PCT Filed: Sep. 20, 2023

(86) PCT No.: PCT/KR2023/014281

§ 371 (c)(1),
(2) Date: Jul. 26, 2024

(87) PCT Pub. No.: WO2024/111842

PCT Pub. Date: May 30, 2024

(65) Prior Publication Data

US 2025/0151928 A1 May 15, 2025

(30) Foreign Application Priority Data

Nov. 21, 2022 (KR) ..... 10-2022-0156661

(51) Int. Cl.
*A47F 3/00* (2006.01)
*A47F 11/10* (2006.01)

(52) U.S. Cl.
CPC ..... *A47F 3/001* (2013.01); *A47F 3/005* (2013.01); *A47F 11/10* (2013.01)

(58) Field of Classification Search
CPC ..... A47F 3/001; A47F 3/005; A47F 3/0404; A47F 3/0408; A47F 3/0413;
(Continued)

(56) References Cited

U.S. PATENT DOCUMENTS

2013/0002098 A1* 1/2013 Jafa ..... F25D 23/063 29/890.035
2013/0293141 A1 11/2013 Pas
2018/0127150 A1 5/2018 Adanur et al.

FOREIGN PATENT DOCUMENTS

KR 10-2000-0009653 A 2/2000
KR 10-2013-0034367 A 4/2013
(Continued)

*Primary Examiner* — Thomas M Sember
(74) *Attorney, Agent, or Firm* — Birch, Stewart, Kolasch & Birch, LLP

(57) ABSTRACT

Disclosed is a show case capable of managing and displaying objects stored therein. A show case according to one aspect of the present disclosure is a show case having an accommodation space in which an object is stored, and includes: a body; a moving body configured to form the accommodation space together with the body and including a transparent window; a blowing part configured to circulate air in the accommodation space; a first illumination configured to illuminate an object placed on a bottom surface of the accommodation space; a second illumination configured to illuminate a rear surface of the accommodation space; an input part to which an image of the object accommodated in the accommodation space is input; and a controller configured to recommend a type of second illumination to a user depending on the image input to the input part.

16 Claims, 17 Drawing Sheets

(58) Field of Classification Search
CPC .. A47F 3/0434; A47F 3/06; A47F 3/10; A47F 3/11; A47F 11/10; A47F 7/08; A47F 5/0081; A47F 5/0087; F25D 27/00; F25D 27/005; A47B 61/04; F21V 33/00; H05B 47/10
USPC ..... 362/125
See application file for complete search history.

(56) References Cited

FOREIGN PATENT DOCUMENTS

| | | | | |
|---|---|---|---|---|
| KR | 10-2014-0032725 | A | 3/2014 | |
| KR | 10-1888374 | B1 | 9/2018 | |
| KR | 10-2019-0020529 | A | 3/2019 | |
| WO | WO-2013048146 | A2 * | 4/2013 | ..... A47F 3/11 |

* cited by examiner

SHOW CASE

CROSS REFERENCE TO RELATED APPLICATIONS

This application is the National Phase of PCT International Application No. PCT/KR2023/014281, filed on Sep. 20, 2023, which claims priority under 35 U.S.C. 119(a) to Patent Application No. 10-2022-0156661, filed in the Republic of Korea on Nov. 21, 2022, all of which are hereby expressly incorporated by reference into the present application.

TECHNICAL FIELD

The present invention relates to a show case, and more particularly, to a show case that manages and displays goods stored therein.

BACKGROUND ART

Only when shoes should be properly kept, the shoes can be worn for a long time without breaking the shape of the shoes. When the shoes are stacked in layers, the shape can be deformed. In general, a shoes cabinet is used for organization and keeping of the shoes.

In recent years, people who collect shoes of popular brands as part of hobby or financial tech have appeared, and a show case has been disclosed which is configured to keep and display the shoes.

US Patent Unexamined Publication No. 2018-0127150 (hereinafter, referred to as 'Prior Document 1') discloses "modular storage container", and the modular storage container includes a housing, a door panel, a fan, and a light source.

According to Prior Document 1 above, the housing has a rectangular parallelepiped box shape having an opening on a front surface thereof. The housing has an accommodation space therein. The door panel opens/closes the opening of the housing, and is configured to be transparent or translucent.

In Prior Document 1 above, the fan is installed on a rear panel of the housing. When the fan rotates, air in the accommodation space is ventilated to outside air. An air duct is formed in the housing for an air flow between the outside air and the accommodation space. The light source is installed in an upper panel and illuminates the accommodation space.

According to Prior Document 1 above, since internal air of the container is configured to be ventilated to the outside air, a possibility that an internal environment (temperature and humidity) of the container will be influenced by an external environment (temperature and humidity) of the container increases. That is, it may be difficult to control the internal temperature and humidity of the container.

For example, according to Prior Document 1 above, since the internal air of the container is just ventilated to the outside air, the humidity of the accommodation space can be continuously maintained when the humidity of the outside air is high like the rainy season. The air may change a color and a shape of the shoe stored in the container, and act to cause the shoe to be contaminated by mold and bacteria which are easy to breed at high temperature and humidity.

As such, in that Prior Document 1 above does not consider a technology of maintaining the internal temperature and humidity of the container in an optimal state, there is a risk of deformation or contamination of the shoe in the process of using the container by a user.

Further, according to Prior Document 1 above, the inside of the container can viewed only through a door panel, and the inside of the container cannot be viewed at a left side or a right side of the container, so there is a limit in increasing a display effect of the shoe.

In relation to a technology of displaying the shoes for a commercial purpose, Korean Patent Unexamined Publication No. 2013-0034367 (hereinafter, referred to as 'Prior Document 2') discloses a show case having transmissive display having transparent display", and the resulting case is configured to include a show case body, a transparent display means, a turntable, a touch panel, and an LED.

The show case body has a space capable of storing products such as the shores therein. The transparent display means is installed on a front surface of the show case body. The products are seated on the turntable, and rotate inside the show-case body by the rotation of the turntable. The LED illuminates the products inside the show case body.

However, in that Prior Document 2 above does not consider a technology of controlling the internal temperature and humidity of the show case, there is a risk of deformation or contamination of the shoe in a state in which the show is stored inside the show case.

Further, according to Prior Document 2 above, the inside of the show case can be viewed only through the transparent display means, and the inside of the show case cannot be viewed at the left side or the right side of the show case, so there is a limit in increasing the display effect of the shoe.

Korean Patent Unexamined Publication No. 10-2000-0009653 (hereinafter, referred to as 'Prior Document 3') discloses "The shoes cabinet for the sanitization", and the resulting shoes cabinet is configured to include a body, an infrared radiation unit, a circulation fan, an air circulation passage, a sanitization filter unit, etc.

Prior Document 3 above discloses that the shoes are dehumidified, sanitized, and deodorized by far infrared rays and filters while storing the shoes.

However, according to Prior Art 3 above, the shoes cannot be displayed.

As described above, conventional devices that accommodate the shoes therein have a limit in the care of the shoes and the display of the shoes.

As a result, in the development of a shoe care device, considering whether the display effect of the shoes can be maximized while constantly maintaining an environment of an internal space (hereinafter, referred to as 'accommodation space') of the shoe care device, whether the accommodation space can be easily opened and closed, whether the shoes can be effectively stored and withdrawn in a state in which the accommodation space is opened, whether structural stability of the shoe care device can be ensured in a state in which the accommodation space is maximally opened, etc., is required.

Moreover, it should be considered whether structural rigidity of a lowest shoe care device can be maintained for a long period even though the shoe care devices are stacked in multiple layers, whether electrical stability can be effectively guaranteed even though the shoe care device is used for a long period, whether an interior effect by the shoe care device can be maximized in addition to the display effect of the shoe, whether internal components are appropriately arranged in a limited space, whether use convenience is excellent, etc., should also be considered, and the development of the shoe care device considering all of the points is required.

DISCLOSURE

Technical Problem

The present disclosure aims to solve the above problems of the show case that accommodates objects therein.

Specifically, the present disclosure aims to provide a show case capable of satisfying the needs of users who wish to store and maintain an object in the best condition all the time by giving both an object display effect of displaying the object and an object management effect of preventing deformation or contamination of the object.

In addition, the present disclosure aims to provide a show case capable of maximizing the display effect of an object by intensively illuminating the area where the object is placed and capable of improving the interior effect of the space where the object is accommodated by illuminating the rear surface of the accommodation space.

In addition, the present disclosure aims to provide a show case that recommends the most suitable illumination based on the object stored in the accommodation space to the user, thereby providing convenience and improving the illumination aesthetics.

The technical problems to be solved in the present disclosure are not limited to the technical problems mentioned above, and other technical problems that are not mentioned will be clearly understood by those skilled in the art to which the present disclosure belongs from the description below.

Technical Solution

In order to attain the above or other purposes, a show case according to one aspect of the present disclosure is configured to accommodate an object in the accommodation space and display the object to be isolated from the outside, as well as to appropriately maintain the environment of the accommodation space. Specifically, the show case is configured to accommodate an object in the accommodation space formed by a body and a moving body and then switch to a closed state to display the object, and at the same time, configured to circulate the air in the accommodation space through a blowing part to control the state of the accommodation space.

In addition, the show case according to one aspect of the present disclosure is configured to illuminate the background of the object, as well as the object, through the illumination arrangement. Specifically, a first illumination is configured to intensively illuminate the area where the object is placed, and a second illumination is configured to illuminate the rear surface of the accommodation space.

In addition, the show case according to one aspect of the present disclosure is configured to recommend the most suitable illumination to the user on the basis of the object accommodated in the accommodation space. Specifically, a controller is configured to recommend the most suitable second illumination to the user on the basis of the object image input to an input part.

In addition, in the show case according to one aspect of the present disclosure, the object image may be input through a portable device, so the type of second illumination to be recommended may be displayed on the portable device.

In addition, in the show case according to one aspect of the present disclosure, a reference line may be displayed when capturing the object image through the portable device.

In addition, in the show case according to one aspect of the present disclosure, a first illumination may operate when capturing the object image through the portable device.

In addition, in the show case according to one aspect of the present disclosure, dummy areas may be removed when capturing the object image through the portable device.

In addition, in the show case according to one aspect of the present disclosure, at least one of similar color temperature illumination, similar monochromatic illumination, and similar spectrum illumination may be recommended to the user from among preset illuminations that are set in advance.

In addition, in the show case according to one aspect of the present disclosure, the similar color temperature illumination that goes well with pixels having higher brightness in the object image may be recommended.

In addition, in the show case according to one aspect of the present disclosure, the similar color temperature illumination that goes well with pixels having higher chroma in the object image may be recommended.

In addition, the show case according to one aspect of the present disclosure may utilize a color palette obtained by amplifying pixels having higher chroma in the object image and classifying the same into clusters.

In addition, in the show case according to one aspect of the present disclosure, the similar monochromatic illumination may be recommended in order of going well with the color with the highest proportion in the color palette derived as a plurality of clusters.

In addition, in the show case according to one aspect of the present disclosure, the similar spectrum illumination in a spectrum state may be recommended in order of going well with the color with the highest proportion in the color palette derived as a plurality of clusters.

In addition, the show case according to one aspect of the present disclosure may identify whether or not the object image has various colors through the Euclidean distances between three colors with relatively high distribution in the color palette derived as a plurality of clusters.

In addition, in the show case according to one aspect of the present disclosure, rainbow-typed similar spectrum illumination may be preferentially recommended if the colors of the object image are diverse or if the property of the color with the highest proportion in the color palette derived as a plurality of clusters is not distinct.

In addition, the show case according to one aspect of the present disclosure may identify whether or not the object image is achromatic through the property of the color with the highest proportion in the color palette derived as a plurality of clusters.

In addition, in the show case according to one aspect of the present disclosure, the similar color temperature illumination may be preferentially recommended over the similar monochromatic illumination if the object image is achromatic.

In addition, in the show case according to one aspect of the present disclosure, the similar spectrum illumination may be recommended, regardless of the priority between the similar monochromatic illumination and the similar color temperature illumination to be recommended.

The solutions to the technical problems in the present disclosure are not limited to the solutions mentioned above, and other solutions not mentioned will be clearly understood by those skilled in the art to which the present disclosure belongs from the description below.

DESCRIPTION OF DRAWINGS

FIG. 5 does not illustrate the shoe.

MODES FOR THE INVENTION

Figure 1A:
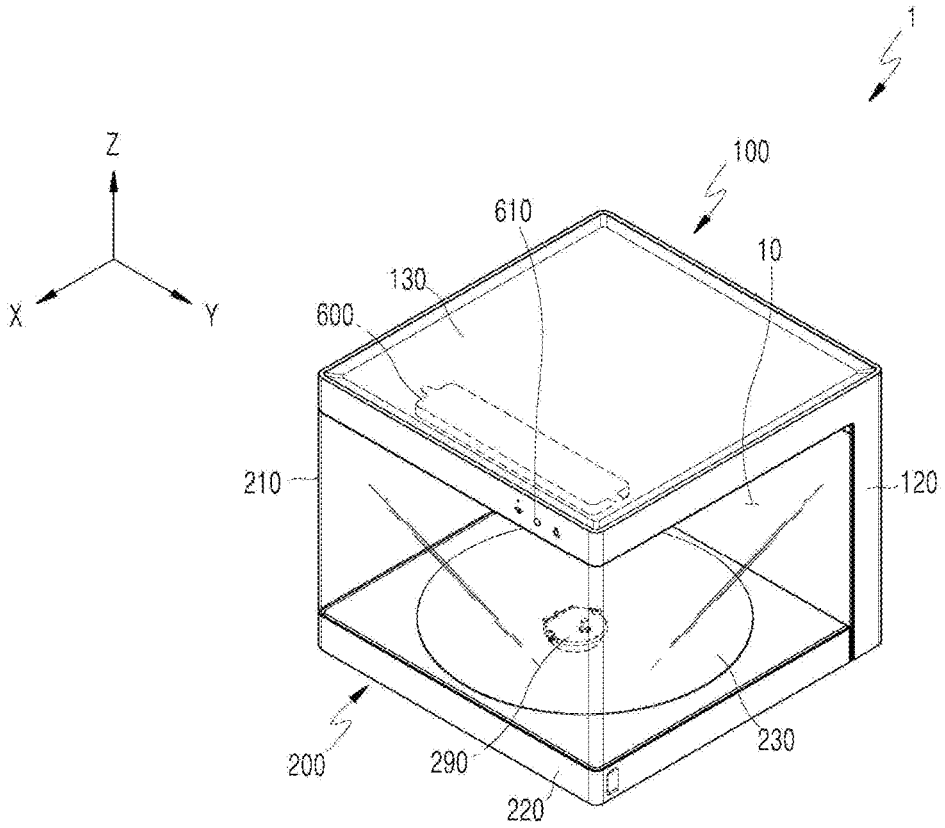
FIG. 1*a* is a perspective view illustrating a show case according to an embodiment of the present invention.

Hereinafter, embodiments disclosed in this specification will be described in detail with reference to the accompanying drawings and the same or similar components are denoted by the same or similar reference numerals, and duplicated description thereof will be omitted. Suffixes "module" and "unit" for components used in the following description are given or mixed in consideration of easy preparation of the present invention only and do not have their own distinguished meanings or roles. Further, in describing the embodiment disclosed in this specification, a detailed description of related known technologies will be omitted if it is determined that the detailed description makes the gist of the embodiment disclosed in this specification unclear. Further, it is to be understood that the accompanying figures are just used for easily understanding the embodiments disclosed in this specification and a technical spirit disclosed in this specification is not limited by the accompanying figures and all changes, equivalents, or substitutes included in the spirit and the technical scope of the present invention are included.

Terms including an ordinary number, such as first and second, are used for describing various elements, but the elements are not limited by the terms. The terms are used only to discriminate one element from another element.

It should be understood that, when it is described that a component is "connected to" or "accesses" another component, the component may be directly connected to or access the other component or a third component may be present therebetween. In contrast, when it is described that a component is "directly connected to" or "directly accesses" another component, it is understood that no element is present between the element and another element.

A singular form includes a plural form if there is no clearly opposite meaning in the context.

In the present application, it should be understood that term "include" or "have" indicates that a feature, a number, a step, an operation, a component, a part or the combination thereof described in the specification is present, but does not exclude a possibility of presence or addition of one or more other features, numbers, steps, operations, components, parts or combinations thereof, in advance.

The present disclosure discloses a show case 1. The show case 1 is configured to display objects while accommodating the object therein. The show case 1 may be configured to manage the object so as to maintain the physical/chemical state of the object contained therein.

The objects described in the present disclosure may include one or more of shoes, wallets, bags, dolls, toys, plastic models, accessories, and souvenirs. That is, the show case 1 may be configured to display and manage one or more of shoes, wallets, bags, dolls, toys, plastic models, accessories, and souvenirs.

The show case described in the present disclosure may be a device that displays and manages shoes among the objects.

The show case described in the present disclosure may be a device that displays and manages objects other than shoes.

The following description will be made on the basis of shoes as an example of the object to be displayed and managed. The shoes described in the present disclosure may be replaced with objects other than shoes.

When the show case described in the present disclosure is intended to display and manage shoes, the show case may be referred to as a shoe care device.

When the shoe is directly exposed to dust, water, heat, and/or sunshine, a fiber material of the shoe may be damaged over time, and a color and a form of the shoe may be changed.

In order to keep the shoe in an original state (e.g., a state of the shoe at the time of purchase or a state of a clean shoe) for a long time, the shoe should not be exposed much to light and the shoe should be kept at a place that is not too cold or hot. Further, the shoe needs to be kept at a place at which a temperature and a humidity are appropriately maintained.

Since the shoe made of a leather or suede material is easily colored or has mold, the shoe should be kept in an environment where temperature and humidity are appropriately maintained. A mothball acquired by solidifying pesticides and fragrances have a unique chemical smell that makes it difficult to remove because the smell permeates the shoe when the mothball is kept jointly with the shoe.

Further, when the shoes are stacked in layers, the form of the shoe may be changed by an applied load.

Meanwhile, as described above, in recent years, users who collect shoes of popular brands as part of a hobby or financial tech has increased, and the care of the shoe and the display of the shoe has become important needs of users.

Considering the points, a show case according to an embodiment of the present invention is configured to safely keep the shoe, establish and adjust an environment (e.g., a predetermined range of temperature, humidity, etc.) required for each shoe, and effectively display the shoe, and increase use convenience of the user.

A first direction X, a second direction Y, and a third direction Z described in the embodiment of the present invention may be directions orthogonal to each other.

The first direction X and the second direction Y may be directions parallel to a horizontal direction, and the third direction Z may be a direction parallel to a vertical direction. When the first direction X is a direction parallel to the front and rear direction, the second direction Y may be a direction parallel to a left and right direction.

In describing embodiments of the present invention, except for a case which is particularly differently limited, the first direction X, the second direction Y, and the third direction Z may be appreciated as a front direction, a left direction, and an upper direction, respectively.

Figure 1B:
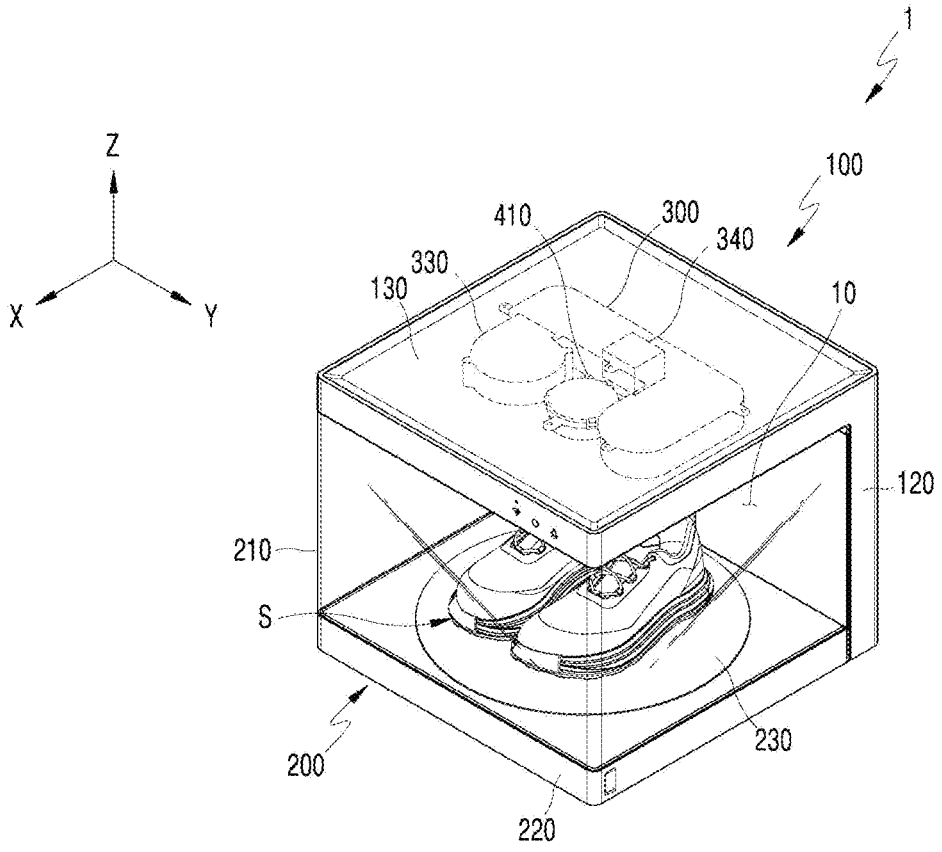
FIG. 1*b* is a perspective view illustrating a state in which a shoe is stored in an accommodation space of the show case of FIG. 1*a*.

FIG. 1*a* is a perspective view illustrating a show case 1 according to an embodiment of the present invention. FIG. 1*a* illustrates a state in which an internal space (hereinafter, referred to as 'accommodation space 10') of the show case 1 is closed. FIG. 1*b* is a perspective view illustrating a state in which a shoe S is stored in the accommodation space 10 of the show case 1 of FIG. 1*a*.

Figure 2A:
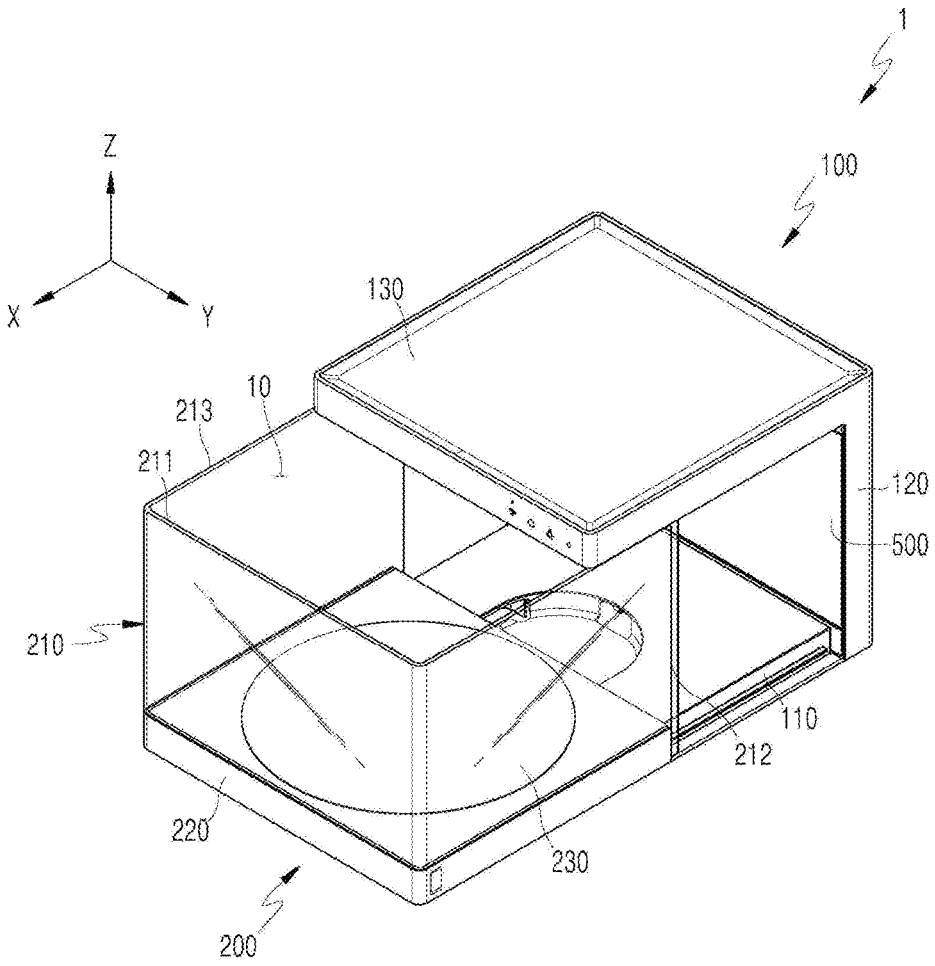
FIG. 2*a* is a perspective view illustrating a state in which the accommodation space of the show case of FIG. 1*a* is opened.
Figure 2B:
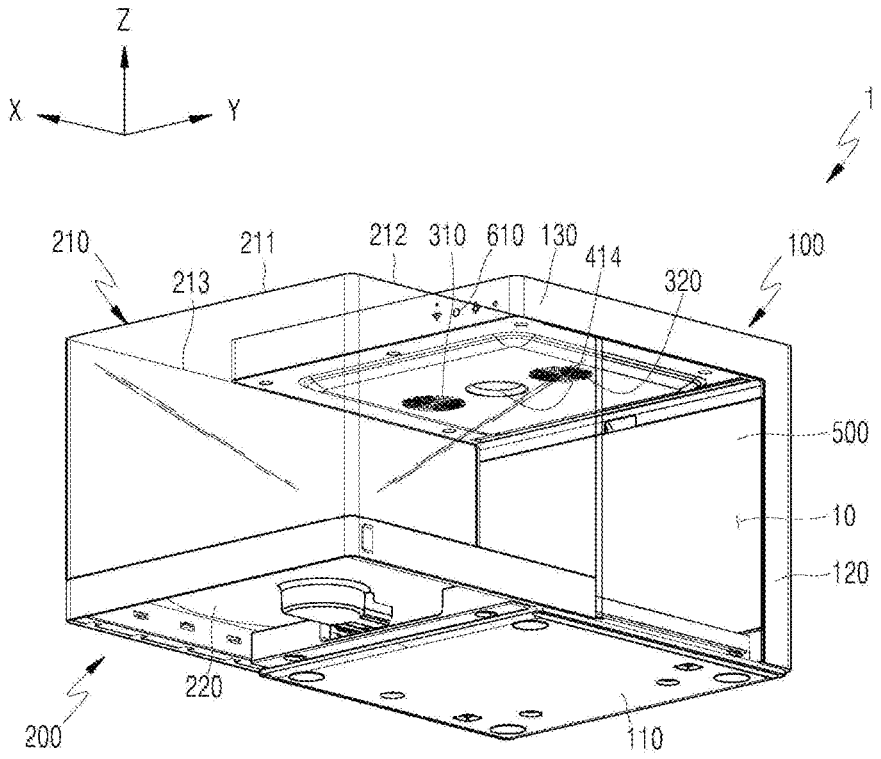
FIG. 2*b* is a perspective view illustrating a view of the show case of FIG. 2*a* viewed in another direction.

FIG. 2*a* is a perspective view illustrating a state in which the accommodation space 10 of the show case 1 of FIG. 1*a* is opened. FIG. 2*b* is a perspective view illustrating a view of the show case of FIG. 2*a* viewed in another direction.

As illustrated I FIGS. 1*a* and 1*b*, the show case 1 according to the embodiment is configured to include a body 100 and a moving body 200.

The body 100 and the moving body 200 form the accommodation space 10 accommodating the shoe S jointly. The body 100 and the moving body 200 are coupled to move with respect to each other. The moving body 200 may be coupled to the body 100 to reciprocally move in a horizontal direction.

The show case 1 illustrated in FIG. 1*a* may be changed like the show case 1 illustrated in FIG. 2*a*. That is, the moving body 200 may slidably move in a first direction X with respect to the body 100, and the show case 1 is transformed from the closed state to the opened state, and the accommodation space 10 may be opened.

The show case 1 illustrated in FIG. 2*a* may be changed like the show case 1 illustrated in FIG. 1*a* again. That is, the moving body 200 may slidably move in an opposite direction to the first direction X with respect to the body 100, and the show case 1 is transformed from the opened state to the closed state, and the accommodation space 10 may be closed.

As such, in the show case 1 according to the embodiment of the present invention, the moving body 200 may move the first direction X or the opposite direction to the first direction X with respect to the body 100, and reciprocally move in front and rear directions.

In the state in which the accommodation space 10 is closed, the accommodation space 10 may be sealed from outside air. Therefore, when the shoe S is accommodated in the accommodation space 10 and the accommodation space 10 is closed, a contact of the shoe S with dust and moisture of the outside air may be interrupted.

The body 100 may form an upper surface and a rear surface of the accommodation space 10.

The moving body 200 may form a front surface, a lower surface, and both side surfaces of the accommodation space 10.

The accommodation space 10 may be formed in a hexahedral form. However, the accommodation space 10 of the show case 1 according to the embodiment of the present invention is not limited to such a shape, and may be configured in various three-dimensional shapes.

The body 100 and the moving body 200 may form an overall appearance of the show case 1. An exterior of the show case 1 may be configured in the hexahedral form. That is, in the state in which the body 100 and the moving body 200 are coupled to each other and the accommodation space 10 is closed, the external appearance of the show case 1 may be configured in the hexahedral form. However, the show case 1 according to the embodiment of the present invention is not limited to such a shape, and may be configured in various three-dimensional shapes.

The body 100 may include an upper body 130, a middle body 120, and a lower body 110.

The upper body 130 is positioned at an upper side of the accommodation space 10. The upper body 130 forms the upper surface of the accommodation space 10. The upper body 130 may form an uppermost portion of the show case 1. The upper surface of the upper body 130 may form a flat surface along a substantially horizontal surface. When a plurality of show cases 1 is provided, any one show case 1 may be placed on the upper surface of the upper body 130 of the other one show case 1, and the show cases 1 may be stacked on each other.

The lower body 110 is positioned below the accommodation space 10. The lower body 110 may form a lowermost portion of the show case 1. The lower body 110 may form a bottom portion of the show case 1.

The middle body 120 is positioned behind the accommodation space 10. The middle body 120 forms the rear surface of the accommodation space 10. The middle body 120 may connect the upper body 130 and the lower body 110 behind the accommodation space 10. The middle body 120 may form a rear wall surface of the show case 1.

The body 100 is configured to include the upper body 130, the middle body 120, and the lower body 110, and as a result, the body 100 may form a substantially 'C' form on the side view.

As described above, the moving body 200 is configured to move forward and backward with respect to the body 100. The moving body 200 may include a base 220, a transparent window 210, and a turntable 230.

The base 220 may be coupled to the lower body 110 to be slidably movable in the first direction X. The base 220 may form the bottom portion of the moving body 200. The base 220 may be positioned at the upper side of the lower body 110. A bottom surface of the base 220 may be positioned in close contact with or in proximity to the upper surface of the lower body 110.

The transparent window 210 may form of extending upward from the base 220. The transparent window 210 may form the front surface, and both side surfaces (a left surface and a right surface) of the accommodation space 10. The transparent window 210 may be made of a transparent or translucent material.

Light inside and outside the accommodation space 10 may pass through the transparent window 210. The transparent window 210 may be made of a material which is weather-resistant to prevent discoloration. The transparent window 210 may be made of an acrylic (PMMA) material which is weather-resistant and scratch-resistant.

The transparent window 210 may prevent a beam having a predetermined wavelength from being introduced into the accommodation space 10. As an example, the transparent window 210 may be configured to block ultraviolet rays. The ultraviolet rays as an electromagnetic wave in which a wavelength corresponds to 10 to 397 nm shorter than visible rays are light which has a strong chemical action and causes getting sunburn or discoloration.

As an example, an ultraviolet-proof film may be attached to an inner surface or an outer surface of the transparent window 210. Alternatively, the inner surface or the outer surface of the transparent window 210 may be UV-coated with an ultraviolet-proof agent.

The transparent window 210 includes a first window 211, a second window 212, and a third window 213. The first window 211 may form the front surface of the accommodation space 10. The second window 212 may form the left surface of the accommodation space 10. The third window 213 may form the right surface of the accommodation space 10.

In the state in which the shoe S is accommodated in the accommodation space 10, a user may view the shoe S through the transparent window 210. As a result, the show case 1 may be used as a device which may display the shoe S while keeping and caring the shoe S.

As illustrated in FIGS. 1*a* and 1*b*, in the state in which the moving body 200 is positioned relatively at a rearmost side, the accommodation space 10 may be sealed from the outside air. In this case, the accommodation space 10 may be formed in the hexahedral form. In this case, the moving body 200 may be present at a first location and the show case 1 is in the closed state.

As illustrated in FIGS. 2*a* and 2*b*, in the state in which the moving body 200 moves in the first direction X, the accommodation space 10 may be opened. In this case, an upper portion of the first window 211 is spaced to a front side in the first direction X from the front surface of the upper body 130 to form a gap (hereinafter, referred to as 'first gap').

In this case, an upper portion of the first window 212 is spaced to a front side in the first direction X from the front surface of the upper body 120 to form a gap (hereinafter, referred to as 'first gap'). The third window 213 is spaced to the front side in the first direction X from a right side surface of the middle body 120 to form a gap (hereinafter, referred to as 'third gap').

In the state in which the moving body 200 moves in the first direction X as much as possible, i.e., in the state in which the moving body 200 is positioned relatively at a frontmost side, the moving body 200 may be present at a second location and the show case 1 may be in the opened state.

The user may put the shoe S into the accommodation space 10 or withdraw the shoe S from the accommodation space 10 through the first gap. The user may put the shoe S into the accommodation space 10 or withdraw the shoe S from the accommodation space 10 through the first gap. An internal panel 500 may be coupled to the inner surface of the middle body 120 or uncoupled from the inner surface of the middle body 120.

The turntable 230 may form the upper surface on which the shoe S is placed. The upper surface of the turntable 230 may have a circular shape. The turntable 220 may form the lower surface of the accommodation space 10 jointly with the base 220.

The turntable 230 may be rotatably coupled to the base 220 around a vertical axis, i.e., an axis parallel to a third direction Z.

For the rotation of the turntable 230, a motor 290 may be provided in the moving body 200. The motor 290 may be coupled to the base 220. The turntable 230 may rotate in conjunction with the rotation of the motor 290. Rotational force of the motor 290 may be delivered to the turntable 230 through a reducer. The motor 290 may rotate unidirectionally or reciprocally rotate bidirectionally.

The turntable 230 is provided, and as a result, the shoe S may rotate in the accommodation space 10 or a display effect of the shoe S may be enhanced.

The show case 1 may include an operating button 610 and a controller 600. The operating button 610 may be formed in the body 100. As an example, the operating button 610 may be formed on the front surface of the upper body 130. When the user manipulates the operating button 610, the turntable 230 may rotate or stop. The user manipulates the operating button 610 to adjust a rotational speed of the turntable 230. The user may input a rotation time of the turntable 230 into the controller 600 through the operating button 610.

The user manipulates the operating button 610 to rotate the turntable 230 at a predetermined angle. In the state in which the accommodation space 10 is opened, the user may place the shoe S on the upper surface of the turntable 230 by holding any one part (heel top, lining, tong, etc.) of the shoe S. Thereafter, the user manipulates the operating button 610 to rotate the turntable 230 at a predetermined angle.

As an example, the user manipulates the operating button 610 to rotate the turntable 230 at a predetermined angle so that a front and rear direction of the shoe S coincides with the first direction X. Alternatively, the user manipulates the operating button 610 to rotate the turntable 230 at a predetermined angle so that the front and rear direction of the shoe S form a predetermined angle with the first direction X.

Therefore, even though the user places the shoe S on the upper surface of the turntable 230 while gripping any one part of the shoe S, the shoe S may be placed (displaced) in a direction desired by the user.

A sensor (not illustrated) that senses movement of the moving body 200 may be provided in the body 100. When the accommodation space 10 is closed, the controller 600 may rotate the turntable 230 by a signal of the sensor.

A load sensor (not illustrated) may be provided in the base 220. The load sensor may automatically measure a load of the shoe S placed on the turntable 230. The rotational speed of the turntable 230 according to a measurement value of the load sensor may be set in the controller 600. Alternatively, the user may input the rotational speed of the turntable 230 according to the measurement value of the load sensor into the controller 600 through the operating button 610.

A camera (not illustrated) may be provided in the show case 1. The camera may automatically shoot the shoe S placed on the turntable 230. The controller 600 may recognize the shape, size, and/or type of the shoe S through a shooting image of the camera.

The rotational speed of the turntable 230 according to the shape, size, and/or type of the shoe S may be set in the controller 600. Alternatively, the user may input the rotational speed of the turntable 230 according to the shape, size, and/or type of the shoe S into the controller 600 through the operating button 610.

The show case 1 may include an operating sensor. The operating sensor may sense an access of the user. The turntable 230 may be rotated or stopped by the sensing signal of the operating sensor.

Figure 3A:
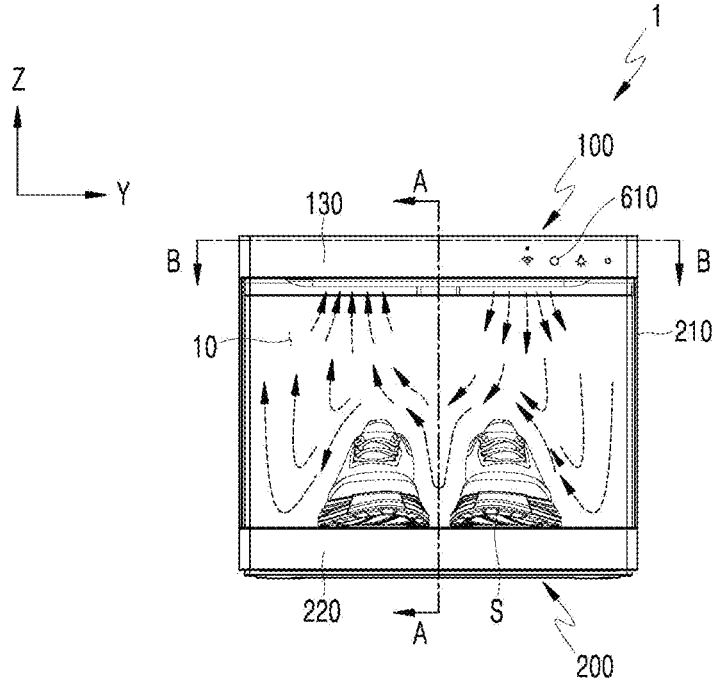
FIG. 3*a* is a side view illustrating a use state of the show case of FIG. 1*b*.

FIG. 3*a* is a side view illustrating a use state of the show case 1 of FIG. 1*b*. FIG. 3*a* illustrates a state of illuminating the shoe S in the accommodation space 10.

Figure 3B:
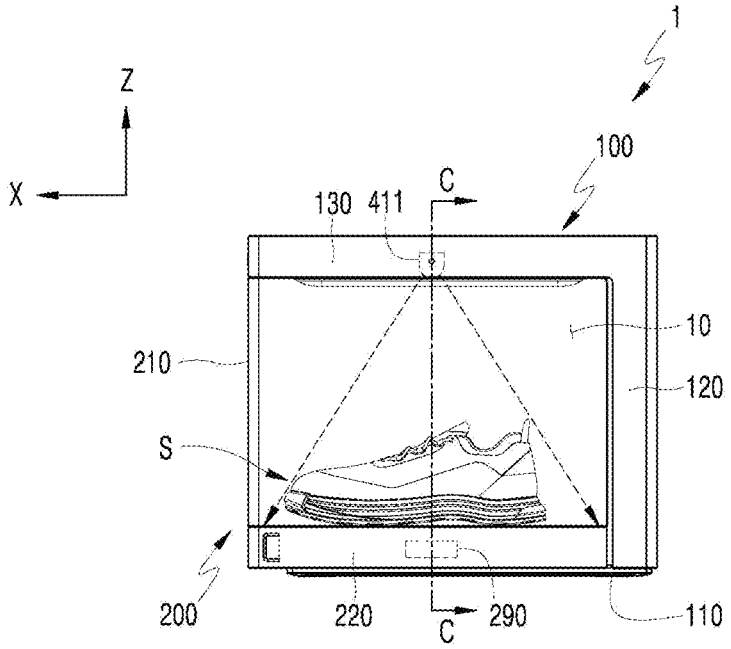
FIG. 3*b* is a front view illustrating the use state of the show case of FIG. 1*b*.

FIG. 3*b* is a front view illustrating the use state of the show case 1 of FIG. 1*b*. FIG. 3*b* illustrates an air flow in the accommodation space 10.

The show case 1 according to the embodiment of the present invention may include a first illumination 410. The first illumination 410 may be provided in the upper body 130.

As illustrated in FIG. 3*a*, the first illumination 410 may illuminate the accommodation space 10. The first illumination 410 may include a light source 411 and a lens 414.

The light source 411 may intensively irradiate light onto the upper surface of the turntable 230 on which the shoe S is placed. The light of the light source 411 may intensively illuminate the shoe S placed on the upper surface of the turntable 230. When the illumination 410 is turned, an image of the shoe S stored in the accommodation space 10 may be changed by the light of the light source 411.

The light of the light source 411 may illuminate the accommodation space 10 by passing through the lens 414. An ultraviolet-proof film may be attached to the lens 414 or the ultraviolet-proof agent may be coated on the lens 414 in order to block the ultraviolet rays.

When the user manipulates the operating button 610, the light source 411 may be turned on or off. The user may input an operating time of the light source 411 into the controller 600 through the operating button 610. The user manipulates the operating button 610 to adjust the operating time of the light source 411.

Alternatively, the light source 411 may be turned on or off by the sensing signal of the operating sensor. The controller 600 may turn on-off the light source by the signal of the operating sensor.

Alternatively, the light source 411 may be turned on or off by the sensing signal of the sensor. When the accommodation space 10 is closed, the controller 600 may turn on-off the light source by the signal of the sensor.

Alternatively, the operating time and the operating pattern of the light source according to the measurement value of the load sensor may be set in the controller 600. The user may input the operating time and the operating pattern of the light source 411 according to the measurement value of the load sensor into the controller 600 through the operating button 610.

Alternatively, the operating time and the operating pattern of the light source according to the shape, size, and/or type of the shoe S may be set in the controller 600. The user may input the operating time and the operating pattern of the light source 411 according to the shape, size, and/or type of the shoe S into the controller 600 through the operating button 610.

The light source 411 may be configured to change the color of the light. As an example, the light source 411 may be constituted by Red Green Blue White (RGBW) LEDs. The controller 600 may control current applied to a Red (R) LED, a Green (G) LED, a Blue (B) LED, and a White (W) LED. When the controller 600 controls the current applied to the RGBW LEDs, the aesthetics and a color sense of the shoe S stored in the accommodation space 10 may be variously changed. The user may input a pattern of the current applied to the RGBW LED into the controller 600 through the operating button 610.

Figure 4A:
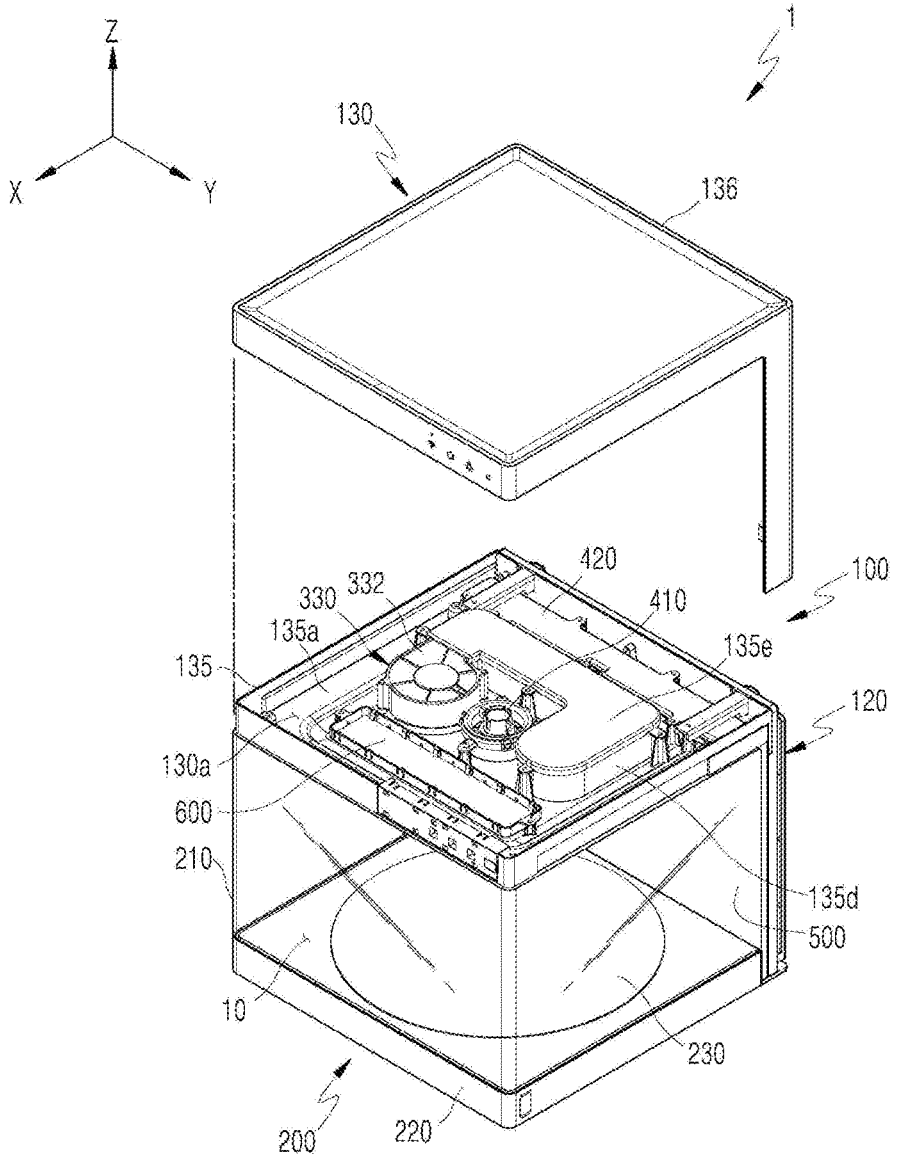
FIG. 4*a* is a perspective view illustrating a state in which a first external cabinet is separated from the body of the show case of FIG. 1*a*.
Figure 4B:
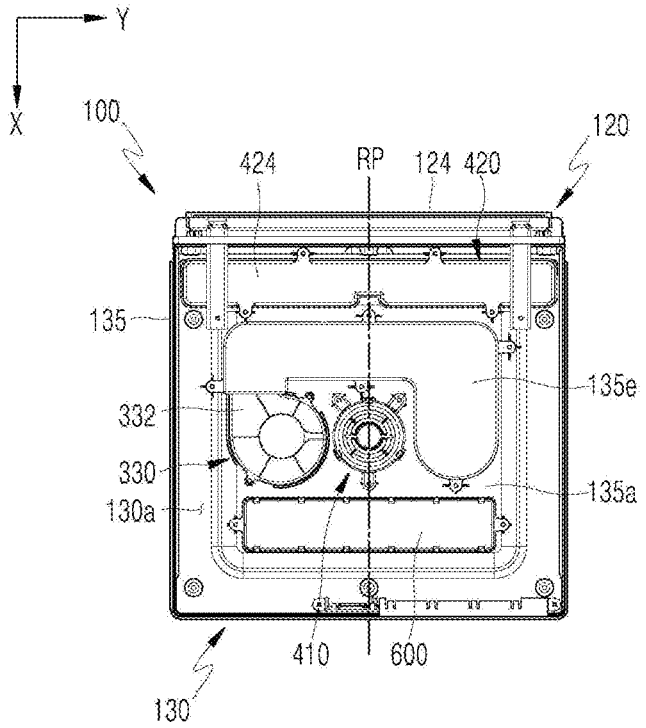
FIG. 4*b* is a plan view illustrating a state in which the first external cabinet is removed from the body of the show case of FIG. 1*a*.
Figure 5:
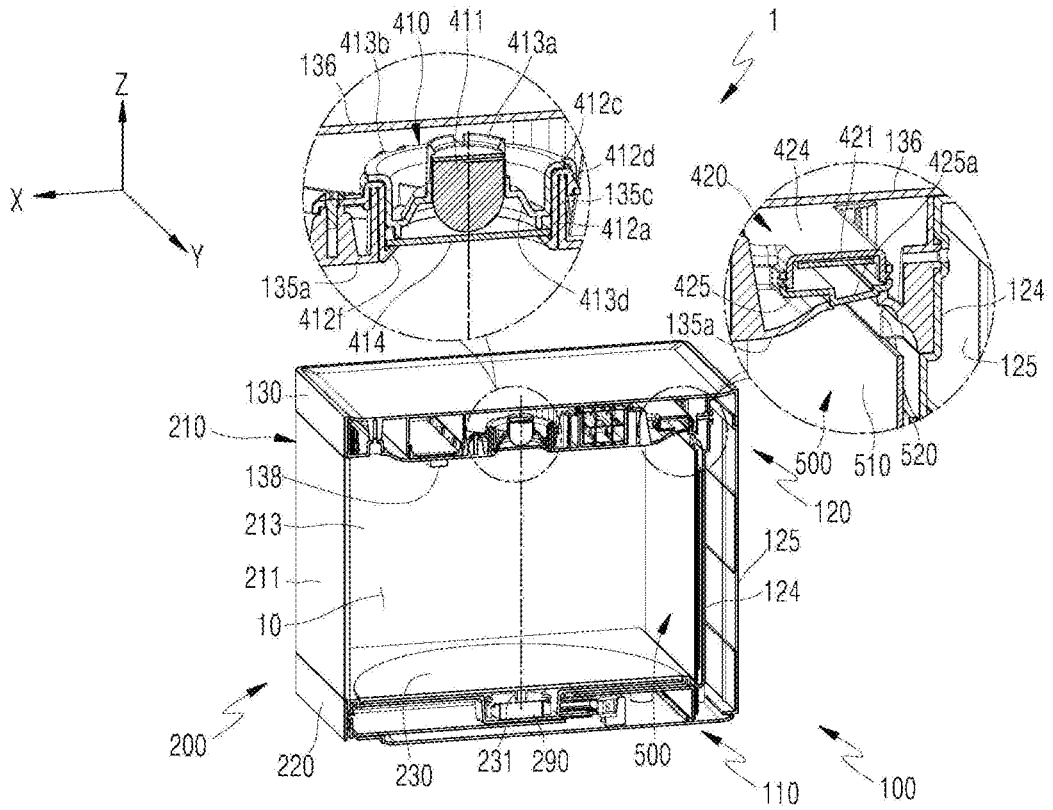
FIG. 5 is a perspective cross-sectional view of the show case of FIG. 3*a* taken along line A-A.

FIG. 4*a* is a perspective view illustrating a state in which a first external cabinet 136 is separated from the body 100 of the show case 1 of FIG. 1*a*. FIG. 4*b* is a plan view illustrating a state in which the first external cabinet 136 is removed from the body 100 of the show case 1 of FIG. 1*a*. FIG. 5 is a perspective cross-sectional view of the show case 1 of FIG. 3*a* taken along line A-A. FIG. 5 does not illustrate the shoe S.

As illustrated in FIGS. 4*a* to 5, the show case 1 may include a body 100, a moving body 200, a blowing part 330, a first illumination 410, and a second illumination 420.

The body 100 and the moving body 200 may form the accommodation space 10 accommodating the shoe S jointly. The body 100 and the moving body 200 may be coupled to move with respect to each other. The moving body 200 may be coupled to the body 100 to reciprocally move in the front and rear direction.

The body 100 may include the upper body 130. The upper body 130 may be positioned above the accommodation space 10. The upper body 130 may have an upper space 130*a* of which gas flow is disconnected from the accommodation space therein. The upper space 130*a* may have a hexahedral shape in which lengths in the first direction X and the second direction Y are larger than a length in the third direction Z.

The upper body 130 may include a first internal cabinet 135 and a first external cabinet 136. The first internal cabinet 135 and the first external cabinet 136 may form the accommodation space 10 jointly.

As illustrated in FIG. 20*a*, the first internal cabinet 135 may have a rectangular box shape opened upward. The first internal cabinet 135 may have an air flow path 300 connected to the accommodation space 10. The first internal cabinet 135 may include an upper bottom plate 135*a*.

The upper bottom plate 135*a* may partition the accommodation space 10 and the upper space 130*a*. The lower surface of the upper bottom plate 135*a* may form the top of the accommodation space 10. The upper surface of the top bottom plate 135*a* may form the bottom of the upper space 130*a*. The upper bottom plate 135*a* may have a plate shape which is wide in the horizontal direction.

The blowing part 330 is a component that circulates air in the accommodation space 10. The blowing part 330 and the air flow path 300 may be provided on the upper surface of the upper bottom plate 135*a*.

The blowing part 330 may include a fan 331 and a fan housing 332. The fan 331 may pressure-feed the air by a rotary motion of an impeller. The fan housing 332 may constitute a part of the air flow path 300.

As illustrated in FIG. 2*b*, the suction port 310 and the discharge port 320 may be formed on the upper bottom plate 135*a*.

The air in the accommodation space 10 may be suctioned into the air flow path 300 through the suction port 310. The air in the air flow path 300 may be discharged to the accommodation space 10 through the discharge port 320. Therefore, air forcibly blown by the blowing part 330 may be circulated in the accommodation space 10 and the air path 300.

As illustrated in FIG. 5, the moving body 200 may include the transparent window 210, the base 220, and the turntable 230.

The body 100 may include the lower body 110. The lower body 110 may be positioned below the accommodation space 10.

The base 220 may be coupled to the lower body 110 to be relatively movable in the front and rear direction so as to open/close the accommodation space 10. The transparent window 210 may be coupled to the base 220. The transparent window 210 may form the front surface, and both side surfaces (a left surface and a right surface) of the accommodation space 10.

The turntable 230 may be rotatably coupled to the base 220 around a vertical axis 231. The base 220 and the turntable 230 may form the lower surface of the accommodation space 10 jointly. The upper surface of the turntable 230 may have the circular shape around the vertical axis 231.

The motor 290 may be provided in the base 220. The motor 290 may deliver the rotary movement to the turntable 230. The rotational axis 231 of the turntable 230 may be in line with the vertical direction.

The axis of the motor 290 may be directly coupled to the rotational axis 231 of the turntable 230. The vertical axis 231 may mean the rotational axis 231 of the turntable 230. An alternate long and short dash line illustrated in FIG. 5 may mean an extension line of the vertical axis 231.

A power supply (not illustrated) may be provided in the base 220. The power supply may supply power to the motor 290. The controller 600 may control the power supplied to the motor 290 from the power supply.

Figure 6:
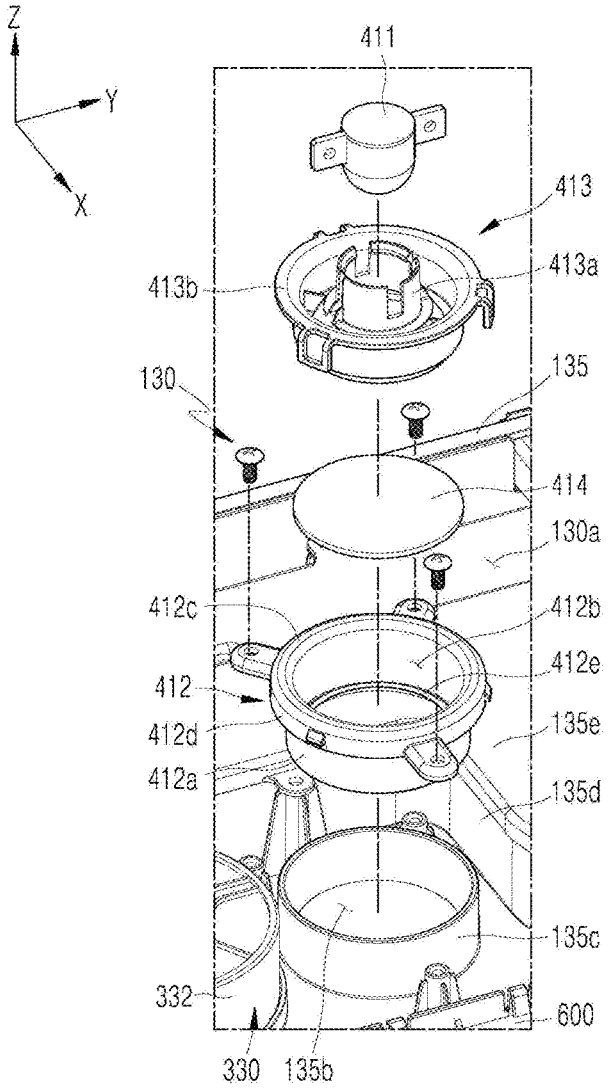
FIG. 6 is an exploded perspective view of the first illumination of the show case of FIG. 4*b*.

FIG. 6 is an exploded perspective view of the first illumination 410 of the show case 1 of FIG. 4*b*.

As illustrated in FIGS. 5 and 6, the first illumination 410 may irradiate light to the upper surface of the turntable 230 on which the shoe S is placed on the extension line of the vertical axis 231. The first illumination 410 may be coupled to the upper bottom plate 135*a*.

The first illumination 410 may include a light source 411, an insertion housing 412, a mounting housing 413, and a lens 414.

The light source 411 may irradiate the light to the accommodation space 10. A power supply (not illustrated) may be provided in the base 220. The power supply may supply the power to the light source 411. The controller 600 may control the power supplied to the light source 411 from the power supply.

The light source 411 may be provided on the extension line of the vertical axis 231.

The accommodation space 10 may be parallel to the first direction X which is the horizontal direction and form a symmetry based on the reference surface RP which is a vertical surface. The extension line of the vertical axis 231 may be positioned within the reference plane RP.

The light of the light source 411 may illuminate the shoe S placed on the bottom of the accommodation space 10. When the illumination 410 is turned, an image of the shoe S stored in the accommodation space 10 may be changed by the light of the light source 411.

When the user manipulates the operating button 610, the light source 411 may be turned on or off. The user may input an operating time of the light source 411 into the controller 600 through the operating button 610. The user manipulates the operating button 610 to adjust the operating time of the light source 411.

The light source 411 may be provided as an LED. Both terminals of the light source 411 may be extended from light source 411 in the horizontal direction. Both terminals may be extended in opposite directions to each other.

The light source 411 may be formed by a white LED emitting white light. The light source 411 may illustrate the shoe S accommodation in the accommodation space 10. Therefore, in the state in which the illumination around the show case 1 is turned off or weak, the visibility of the shoe S stored in the accommodation space 10 may be enhanced. Therefore, the display effect of the shoe S stored in the accommodation space 10 may be enhanced.

Alternatively, the light source 411 may be configured to change the color of the light. As an example, the light source 411 may be formed by a Red Green Blue White (RGBW) LED. The controller 600 may control current applied to a Red (R) LED, a Green (G) LED, a Blue (B) LED, and a White (W) LED.

When the controller 600 controls the current applied to the RGBW LEDs, the aesthetics and a color sense of the shoe S stored in the accommodation space 10 may be variously changed. The user may input a pattern of the current applied to the RGBW LED into the controller 600 through the operating button 610.

A main hole 135*b* and a circular projection portion 135*c* may be formed on the upper bottom plate 135*a*. The circular projection portion 135*c* may be formed to extend upward at the edge of the main hole 135*b*. The main hole 135*b* may extend in the upper and lower direction by the inner surface of the circular projection portion 135*c*.

As illustrated in FIGS. 5 and 6, the insertion housing 412 may include an insertion sleeve 412*a*, a first insertion bending portion 412*c*, and a second insertion bending portion 412*d*. The insertion sleeve 412*a* may have a circular pipe shape. The inner surface of the insertion sleeve 412*a* may form a circular hole 412*b* through which the light of the light source 411 passes. The insertion sleeve 412*a* may be inserted into the main hole 135*b*. The outer surface of the insertion sleeve 412*a* may be opposed to the inner surface of the circular projection portion 135*c*.

The first insertion bending portion 412*c* may be formed to extend outward on the outer surface of the insertion sleeve 412*a*. The first insertion bending portion 412*c* may be seated on the top of the circular projection portion 135*c*.

The second insertion bending portion 412*d* may be formed to extend downward from the first insertion bending portion 412*c*. An upper portion of the circular projection portion 135*c* may be inserted between the insertion sleeve 412*a* and the insertion bending portion. Therefore, a gas flow of the upper space 130*a* and the accommodation space 10 through the circular projection portion 135*c* and the insertion housing 412 may be stopped.

A step portion 412*e* may be formed on the inner surface of the insertion sleeve 412*a* in the circumferential direction. The step portion 412*e* may form a second reflection surface 412*f* that reflects the light of the light source 411, which penetrates the lens 414. The second reflection surface 412*f* may form an axial symmetry around the vertical axis 231. The second reflection surface 412*f* may reflect the light of the light source 411 to the accommodation space 10.

As illustrated in FIGS. 5 and 6, the mounting housing 413 may include a mounting sleeve 413*a*, a mounting bending portion 413*b*, and a closed projection portion 413*c*.

The light source 411 may be coupled to the mounting sleeve 413*a*. The light source 411 may be inserted into the inside of the mounting sleeve 413*a*. A plurality of grooves into which both terminals of the light source 411 are inserted downward may be formed in the mounting sleeve 413*a*. The grooves of the mounting sleeve 413*a* may be formed in opposite directions to each other around the vertical axis 231.

A diameter of an upper end portion of the mounting sleeve 413*a* may be smaller than the diameter of the light source 411. In the process in which the light source 411 is inserted into the inside of the mounting sleeve 413*a*, the mounting sleeve 413*a* may be bending-deformed outward. When both terminals of the light source 411 are completely inserted into the grooves of the mounting sleeve 413*a*, the mounting sleeve 413*a* may be elastically restored. A protrusion may be formed on the inner surface of the upper end portion of the mounting sleeve 413*a*. Therefore, the mounting sleeve 413*a* may prevent detachment of the light source 411.

The mounting sleeve 413*a* may be inserted into the inside of the insertion sleeve 412*a*. The outer surface of the mounting sleeve 413*a* may be opposed to the inner surface of the insertion sleeve 412*a*.

A lower portion of the mounting sleeve 413*a* may form a first reflection surface 413*d* that reflects the light of the light source 411 toward the lens 414. The first reflection surface 413*d* may form the axial symmetry around the vertical axis 231. The first reflection surface 413*d* may reflect the light of the light source 413 to the accommodation space 10.

The mounting bending portion 413*b* may be formed to extend outward on the outer surface of the mounting sleeve 413*a*. The mounting bending portion 413*b* may be seated on the top of the first insertion bending portion 412*c*.

A hook may be formed at any one of the mounting bending portion 413*b* and the second insertion bending portion 412*d*. In addition, a portion to which the hook is hooked may be formed at the other one of the mounting bending portion 413*b* and the second insertion bending portion 412*d*. Therefore, as the mounting bending portion 413*b* is seated on the top of the first insertion bending portion 412*c*, a coupling force may be formed between the insertion housing 412 and the mounting housing 413.

The closed projection portion 413*c* may extend downward on the lower end of the mounting sleeve 413*a*. The closed projection portion 413*c* may be formed around the vertical axis 231 in the circumferential direction.

The lens 414 may be inserted into the inside of the insertion sleeve 412*a*. The lens 414 may be mounted on the top of the step portion 412*e*. The top of the step portion 412*e* may form a contact surface with the lens 414 in the circumferential direction.

As the mounting sleeve 413*a* is inserted into the inside of the insertion sleeve 412*a*, the lens 414 may be in close contact with the bottom of the closed projection portion 413*c*. Therefore, the lens 414 may close the circular hole 412*b*. Therefore, the gas flow of the upper space 130*a* and the accommodation space 10 through the circular hole 412*b* may be stopped.

The light of the light source 411 may illuminate the accommodation space 10 by passing through the lens 414. An ultraviolet-proof film may be attached to the lens 414 or the ultraviolet-proof agent may be coated on the lens 414 in order to block the ultraviolet rays.

As illustrated in FIG. 5, the body 100 may include the middle body 120. The middle body 120 may form the rear surface of the accommodation space 10.

The internal panel 500 may be coupled to the front surface of the middle body 120 in the accommodation space 10. Therefore, the turntable 500 may form the rear surface of the accommodation space 10 jointly with the middle body 120. The internal panel 500 may be detachably coupled to the middle body 120. As an example, the internal panel 500 may be coupled to the front surface of the middle body 120 by a magnetic force.

The front surface of the middle body 120 may generally form the plane. The internal panel 500 may have the thin plate shape. The rear surface of the internal panel 500 may be in close contact with the front surface of the middle body 120. The front surface and/or the rear surface of the internal panel 500 may form a similar shape and a similar area to the front surface of the middle body 120.

Therefore, even though the internal panel 500 is coupled or not coupled to the middle body 120, the hexahedral shape and size of the accommodation space 10 may be maintained substantially constantly. Therefore, even though the internal panel 500 is coupled or not coupled to the middle body 120, the accommodation space 10 may show predetermined aesthetics based on the shape and the size.

The front surface of the internal panel 500 may be made of the same or similar material as the front surface of the middle body 120.

Therefore, even though the internal panel 500 is coupled or not coupled to the middle body 120, the light of the first illumination 410 and the second illumination 420 reflected on the rear surface of the accommodation space 10 may be delivered to a vision of a person who sees the shoe S to be the same or similar. Therefore, even though the internal panel 500 is coupled or not coupled to the middle body 120, the accommodation space 10 may show predetermined aesthetics based on the light.

The internal panel 500 may be configured to accommodate an image sheet 550. The image sheet 500 may mean a sheet including an image to the letter. As an example, the image sheet 550 may be a sheet printed with a photo, a picture, or a letter.

The internal panel 500 may form an insertion space 500*c* accommodating the image sheet 550. The internal panel 500 may include a transparent or translucent material so as to expose the image sheet 550 to the accommodation space 10.

The image sheet 550 may be exposed to the vision of the person who sees the shoe S accommodated in the show case 1. Therefore, the user of the show case 1 may display the photo and the picture on the rear surface of the accommodation space 10.

The insertion space 500*c* may be opened to the upper side. The image sheet 550 may be inserted into the insertion space 500*c* through an upper opening. The image sheet 550 inserted into the insertion space 500*c* may be withdrawn to the outside through the upper opening. Therefore, the user of the show case 1 may display various photos and pictures on the rear surface of the accommodation space 10.

Figure 7:
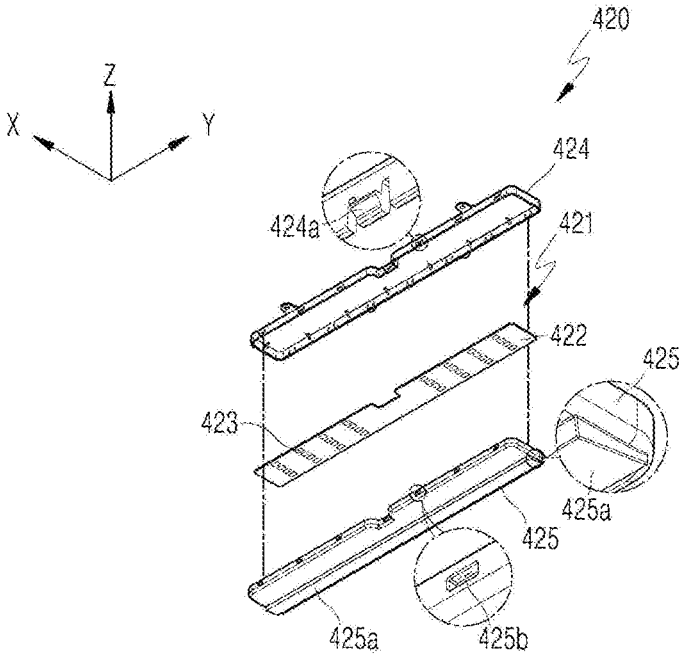
FIG. 7 is an exploded perspective view of the second illumination of the show case of FIG. 4*b*.

FIG. 7 is an exploded perspective view of the second illumination 420 of the show case 1 of FIG. 4*b*.

As illustrated in FIGS. 5 and 7, the second illumination 420 may illuminate the rear surface of the accommodation space 10. The second illumination 420 may be parallel to the first direction X which is the horizontal direction and form the symmetry based on the reference surface RP which is the vertical surface. The extension line of the vertical axis 231 may be positioned within the reference plane RP.

The second illumination 420 may include a light source module 421, a heat dissipation cover 424, and a transmission cover 425.

As illustrated in FIGS. 4*b* and 7, the light source module 421 may be formed to be long in the second direction Y. The light source module 421 may be formed by an LED module. The light source module 421 may include a module substrate 422 and a plurality of white LEDs.

A power supply (not illustrated) may be provided in the base 220. The power supply may supply power to the light source module 421. The controller 600 may control the power supplied to the light source module 421 from the power supply.

The module substrate 422 may be formed to be long in the second direction Y. The plurality of LEDs may be placed on the bottom of the module substrate 422 at a predetermined gap in the second direction Y. Therefore, light which the light source module 421 irradiates onto the rear surface of the accommodation space 10 may form a substantially constant illuminance in the second direction Y.

Therefore, the visibility of the rear surface of the accommodation space 10 is enhanced, and as a result, the display effect of the image sheet 550 accommodated in the internal panel 500 may be enhanced. In particular, in the state in which the illumination around the show case 1 is turned off or weak, the display effect of the image sheet 550 accommodated in the internal panel 500 may be enhanced.

Alternatively, the light source module 421 may be configured to change the color of the light. As an example, the light source module 421 may be constituted by the module substrate 422 and a plurality of Red Green Blue White (RGBW) LEDs. The controller 600 may control current applied to a Red (R) LED, a Green (G) LED, a Blue (B) LED, and a White (W) LED.

When the controller 600 controls the current applied to the RGBW LEDs, the aesthetics and the color sense of the rear surface of the accommodation space 10 may be variously changed. The user may input a pattern of the current applied to the RGBW LED 423 into the controller 600 through the operating button 610.

Meanwhile, a wavelength of the light of the second illumination 420 may vary depending on the temperature and/or the humidity of the accommodation space 10. Here, a change range of the wavelength may be a wavelength range of visible light. That is, the change range of the wavelength may be 400 to 700 nm.

As illustrated in FIG. 5, a measurement sensor 138 measuring the temperature and/or the humidity may be installed at one side of the accommodation space 10. The measurement sensor 138 may be installed in the upper body 130, the middle body 120, or the base 220. As an example, the measurement sensor 138 may be installed on the upper bottom plate 135*a*. The controller 600 may receive a measurement value of the measurement sensor 138.

The controller 600 may control the current applied to the RGBW LED 423 according to the measurement value of the measurement sensor 138. The wavelength of the light emitted by the second illumination 420 may vary depending on the measurement value of the measurement sensor 138. Therefore, a color stimulus of the light reflected on the rear surface of the accommodation space 10 may vary depending on the measurement value of the measurement sensor 138.

The color stimulus is a term that means a stimulus which reflected light of a colored object gives to the color sense of the eye. When the eye of the person is stimulated by the light, there are three color senses of sensing red, green, and blue, and the color may be displayed by a stimulus amount (triple stimulus value) for three color senses.

A current amount applied to the RGBW LED 423 may be set in the controller 600 according to the measurement value of the measurement sensor 138. Alternatively, the user may input the current amount applied to the RGBW LED 423 according to the measurement value of the measurement sensor 138 into the controller 600 through the operating button 610.

An appropriate temperature range may be input into the controller 600. The appropriate temperature range may mean a temperature range suitable for keeping the shoe S. The controller 600 may change the current amount applied to the RGBW LED 423 according to the measurement value of the measurement sensor 138 being within the appropriate temperature range.

As an example, when the measurement value of the measurement sensor 138 is within the appropriate temperature range, the controller 600 may apply the current to the RGBW LED 423 so that the second illumination 420 emits green or blue light.

As an example, when the measurement value of the measurement sensor 138 is out of the appropriate temperature range, the controller 600 may apply the current to the RGBW LED 423 so that the second illumination 420 emits red light.

Alternatively, when the measurement value of the measurement sensor 138 is out of the appropriate temperature range, the controller 600 may apply the current to the RGBW LED 423 so that the second illumination 420 continuously flashes light of a specific color.

An appropriate humidity range may be input into the controller 600. The appropriate humidity range may mean a humidity range suitable for keeping the shoe S. The controller 600 may change the current amount applied to the RGBW LED 423 according to the measurement value of the measurement sensor 138 being within the appropriate humidity range.

As an example, when the measurement value of the measurement sensor 138 is within the appropriate humidity range, the controller 600 may apply the current to the RGBW LED 423 so that the second illumination 420 emits the green or blue light.

As an example, when the measurement value of the measurement sensor 138 is out of the appropriate humidity range, the controller 600 may apply the current to the RGBW LED 423 so that the second illumination 420 emits the red light.

Alternatively, when the measurement value of the measurement sensor 138 is out of the appropriate humidity range, the controller 600 may apply the current to the RGBW LED 423 so that the second illumination 420 continuously flashes light of a specific color.

As illustrated in FIGS. 5 and 7, the heat dissipation cover 424 and the transmission cover 425 may be formed to be long in the second direction Y.

The light source module 421 may be connected to the heat dissipation cover 424. The heat dissipation cover 424 may form the opening at the lower side thereof. The transmission cover 425 may be coupled to at the heat dissipation cover 424 so as to seal the opening of the heat dissipation cover 424.

A hook 424*a* may be formed in any one of the heat dissipation cover 424 and the transmission cover 425. A holing hole 425*b* to which the hook 424*a* is hooked may be formed in any one of the heat dissipation cover 424 and the transmission cover 425. As the transmission cover 425 seals the opening of the heat dissipation cover 424, the hook 424*a* may be hooked to the hooking hole 425*b*. Therefore, the coupling force may be formed between the heat dissipation cover 424 and the transmission cover 425.

Therefore, the heat dissipation cover 424 and the transmission cover 425 may form a space (hereinafter, referred to as 'light source space') accommodating the light source module 421 jointly. The light source space may be formed to be long in the second direction Y.

The top of the module substrate 422 may be coupled to the heat dissipation cover 424 above the light source space. Thermal energy of the light source module 421 may be delivered to the heat dissipation cover 424. The heat dissipation cover 424 may discharge heat of the light source module 421 to the upper space 130*a*. The heat dissipation cover 424 may be made of a metallic material having high thermal conductance.

The LED 423 may be provided on the bottom of the module substrate 422. The transmission cover 425 may include a transmission portion 425*a* that penetrates light of the light source module 421. The transmission portion 425*a* may be formed to be long in the second direction Y.

Therefore, the light of the light source module 421 which penetrates the transmission portion 425*a* may form a substantially constant illuminance in the second direction Y. The transmission cover 425 may be made of a transparent glass or resin material. The front surface of the transmission cover 425 except for the transmission portion 425*a* may be coated with an opaque material.

A hole (hereinafter, referred to as 'rear surface hole') into which the transmission portion 425*a* is inserted may be formed on the upper bottom plate 135*a*. The rear surface hole may be formed to be long in the second direction Y. The transmission portion 425*a* may be inserted into the rear surface hole. The outer surface of the transmission portion 425*a* may be in close contact with the inner surface of the rear surface hole. Therefore, the gas flow of the upper space 130*a* and the accommodation space 10 through the transmission cover 425 and the inner surface of the rear surface hole may be stopped.

Figure 8A:
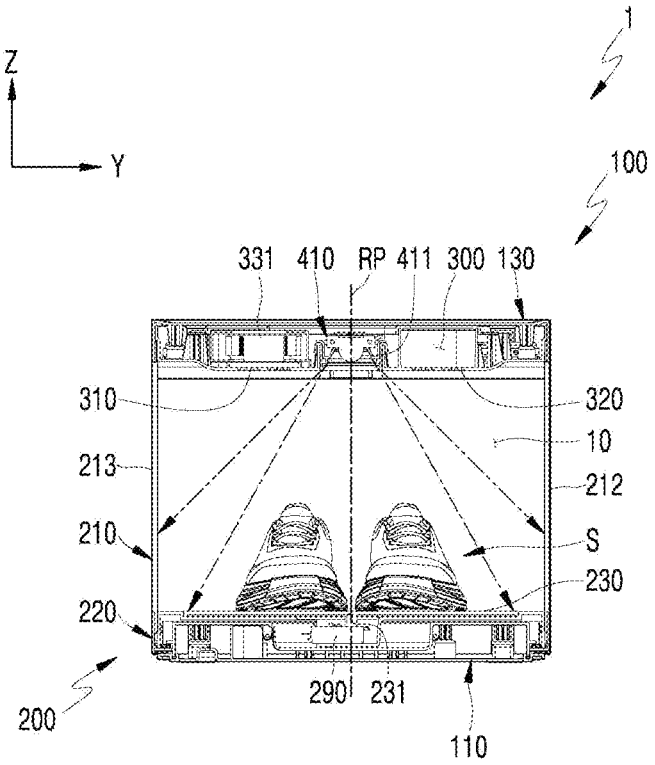
FIG. 8*a* is a cross-sectional view of the show case of FIG. 3*b* taken along line C-C.
Figure 8B:
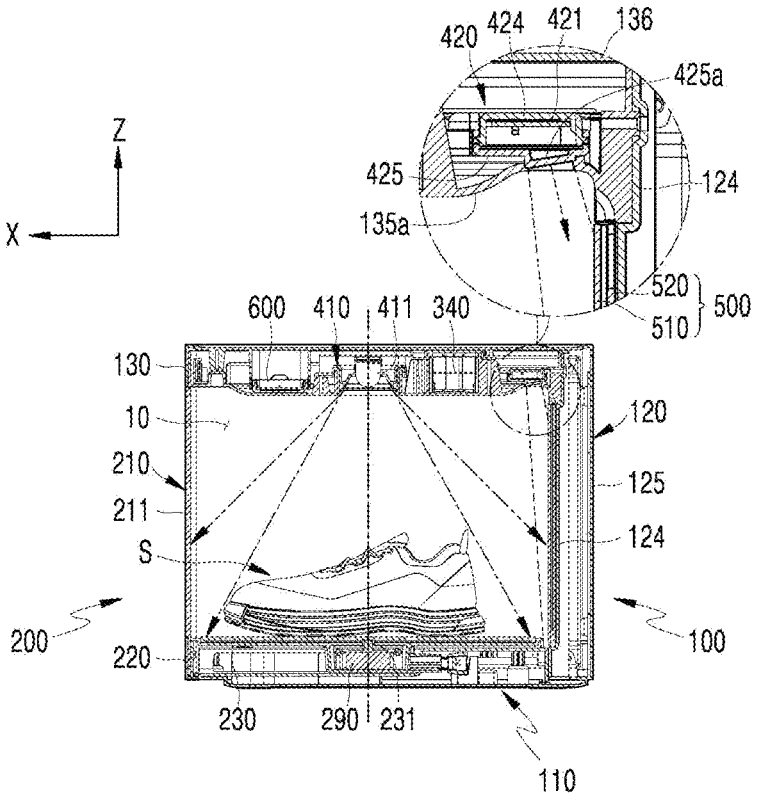
FIG. 8*b* is a cross-sectional view of the show case of FIG. 3*a* taken along line A-A.

FIG. 8*a* is a cross-sectional view of the show case 1 of FIG. 3*b* taken along line C-C. FIG. 8*b* is a cross-sectional view of the show case 1 of FIG. 3*a* taken along line A-A. The alternate long and short dash line illustrated in FIG. 8*b* may mean the extension line of the vertical axis 231.

The accommodation space 10 may be parallel to the first direction X which is the horizontal direction and form the symmetry based on the reference surface RP which is the vertical surface. The extension line of the vertical axis 231 may be positioned within the reference plane RP.

As illustrated in FIGS. 8*a* and 8*b*, the light source 411 may be provided on the extension line of the vertical axis 231. The first illumination 410 may irradiate light to the top of the turntable 230 on which the shoe S is placed on the extension line of the vertical axis 231.

An alternate long and short dash line arrow illustrated in FIGS. 8*a* and 8*b* may mean the extension line of the first reflection surface 413*d*. An alternate long and two short dashes line arrow illustrated in FIGS. 8*a* and 8*b* may mean the extension line of the second reflection surface 412*f*.

As described above, in the state in which the accommodation space 10 is opened, the user may place the shoe S on the top of the turntable 230 by holding any one part (heel top, lining, tong, etc.) of the shoe S.

Thereafter, the user manipulates the operating button 610 to rotate the turntable 230 at a predetermined angle so that the front and rear direction of the shoe S coincides with the first direction X.

Alternatively, the user manipulates the operating button 610 to rotate the turntable 230 at a predetermined angle so that the front and rear direction of the shoe S form a predetermined angle with the first direction X. Alternatively, the user manipulates the operating button 610 to continuously rotate the turntable 230.

A beam angle of the first illumination 410 may form the axial symmetry around the vertical axis 231. Therefore, the light emitted by the first illumination 410 may form the same illuminance around the vertical axis 231 in the circumferential direction.

Therefore, light reflected on the surface of the shoe S may maintain the same color stimulus regardless of a direction which the front and rear direction of the shoe S faces. Therefore, the aesthetics and the color sense of the shoe S stored in the accommodation space 10 may be maintained to be the same regardless of the direction which the front and rear direction of the shoe S faces.

As described above, the transparent window 210 may form the front surface, and both side surfaces (the left surface and the right surface) of the accommodation space 10. The transparent window 210 may include the first window 211, the second window 212, and the third window 213.

The first window 211 may form the front surface of the accommodation space 10. The second window 212 may form the left surface of the accommodation space 10. The third window 213 may form the right surface of the accommodation space 10.

Therefore, the user may observe the shoe S accommodated in the accommodation space 10 at the front side, the left side, and the right side. Further, the user may observe the shoe S accommodated in the accommodation space 10 between front side and the left side and between the front side and the right side of the accommodation space 10.

The beam angle of the first illumination 410 forms the axial symmetry around the vertical axis 231, and as a result, the light reflected on the surface of the shoe S may maintain the same color stimulus regardless of the location of the user based on the accommodation space 10. Therefore, the aesthetics and the color sense of the shoe S stored in the accommodation space 10 may be maintained to be the same.

Hereinafter, for easy understanding of the present invention, a space between the extension line of the vertical axis 231 and the extension line of the first reflection surface 413*d* will be referred to as 'first space'. In addition, a space between the extension line of the first reflection surface 413*d* and the extension line of the second reflection surface 412*f* will be referred to as 'second space'.

As illustrated in FIG. 5, the first reflection surface 413*d* may be provided next to the light source 411 around the extension line of the vertical axis 231. The second reflection surface 412*f* may be provided below the first reflection surface 413*d*. The first reflection surface 413*d* and the second reflection surface 412*f* may form a surface reflecting the light of the light source 411 toward the accommodation space 10.

The second reflection surface 412*f* may be spaced apart from the extension line of the vertical axis 231 further than the first reflection surface 413*d*. In addition, the extension line of the second reflection surface 412*f* may be spaced apart from the vertical axis 231 further than the extension line of the first reflection surface 413*d*. Therefore, the light reflected by the second reflection surface 412*f* may form a lower illuminance than the light reflected by the first reflection surface 413*d*.

As illustrated in FIGS. 8*a* and 8*b*, the light of the first illumination 410 may form a higher illuminance in the first space than the second space. The extension line of the first reflection surface 413*d* may face the edge of the turntable 230. Therefore, the first illumination 410 may intensively illuminate the shoe S placed on the top of the turntable 230. Therefore, the display effect of the shoe S placed on the top of the turntable 230 may be enhanced.

When the shoe S is placed close to the edge of the turntable 230 based on the vertical axis 231, a part of the shoe S may be positioned in the second space. Further, when the shoe S is formed to be long in the vertical direction like boots, a part of the shoe S may be positioned in the second space.

The light of the first illumination 410 forms a lower illuminance in the second space than the first space, a part of the shoe S positioned in the second space may be illuminated. Therefore, even though a part of the shoe S is positioned outside the first space, the first illumination 410 may wholly illuminate the shoe S placed on the top of the turntable 230.

Therefore, even though a part of the shoe S is positioned in the second space, the light reflected on the surface of the shoe S may generally maintain the same color stimulus. Therefore, the aesthetics and the color sense of the shoe S stored in the accommodation space 10 may be generally maintained to be the same.

The dotted line illustrated in FIG. 8*b* may mean the progress of the light of the second illumination 420 penetrating a transmission surface. A dotted-line arrow illustrated in the enlarged diagram of FIG. 8*b* may mean a normal direction of the transmission surface.

According to the Snell's law, when light is incident on a boundary surface of two media having different densities, the reflectance of the light increases as an incident angle increases. Therefore, the transmission portion 425*a* may penetrate the light of the light source module 421 having a smaller incident angle toward the accommodation space 10.

In addition, the transmission portion 425*a* may reflect the light of the light source module 421 having a larger incident angle. Therefore, the light of the light source module 421 which penetrates the transmission portion 425*a* may form a high illuminance around the normal direction of the bottom of the transmission portion 425*a*.

As illustrated in FIG. 8*b*, the normal direction of the bottom of the transmission portion 425*a*, which contacts the accommodation space 10 may face the front surface of the internal panel 500. The top of the transmission portion 425*a* may form a surface parallel to the bottom. Therefore, the second illumination 420 may intensively illuminate the rear surface of the accommodation space 10.

Therefore, the visibility of the rear surface of the accommodation space 10 is enhanced, and as a result, the display effect of the image sheet 550 accommodated in the internal panel 500 may be enhanced. In particular, in the state in which the illumination around the show case 1 is turned off or weak, the display effect of the image sheet 550 accommodated in the internal panel 500 may be enhanced.

Figure 9:
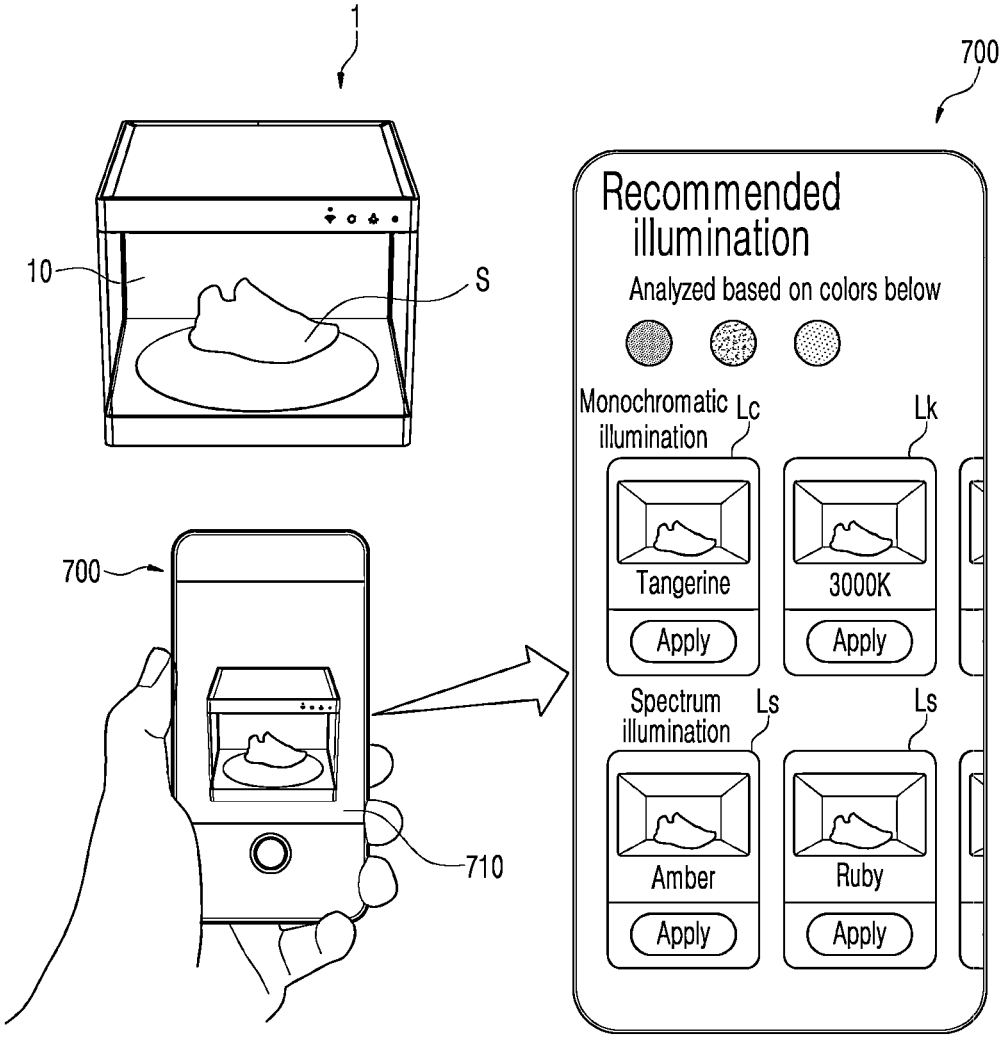
FIG. 9 is a drawing illustrating an example of the state in which a shoe image is input and second illumination is recommended in a show case according to an embodiment of the present disclosure.
Figure 10:
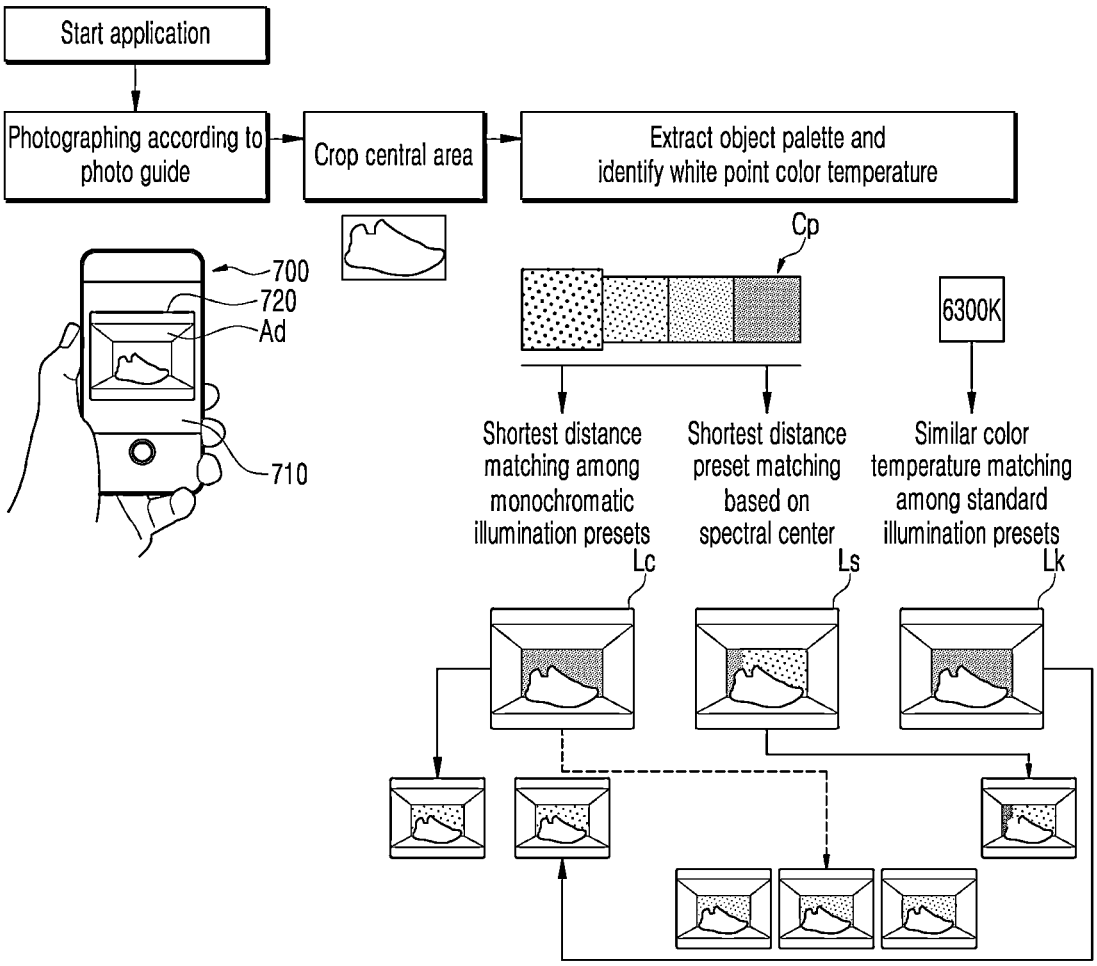
FIG. 10 and FIG. 11 are drawings illustrating an example of a process in which second illumination is recommended in a show case according to an embodiment of the present disclosure.
Figure 11:
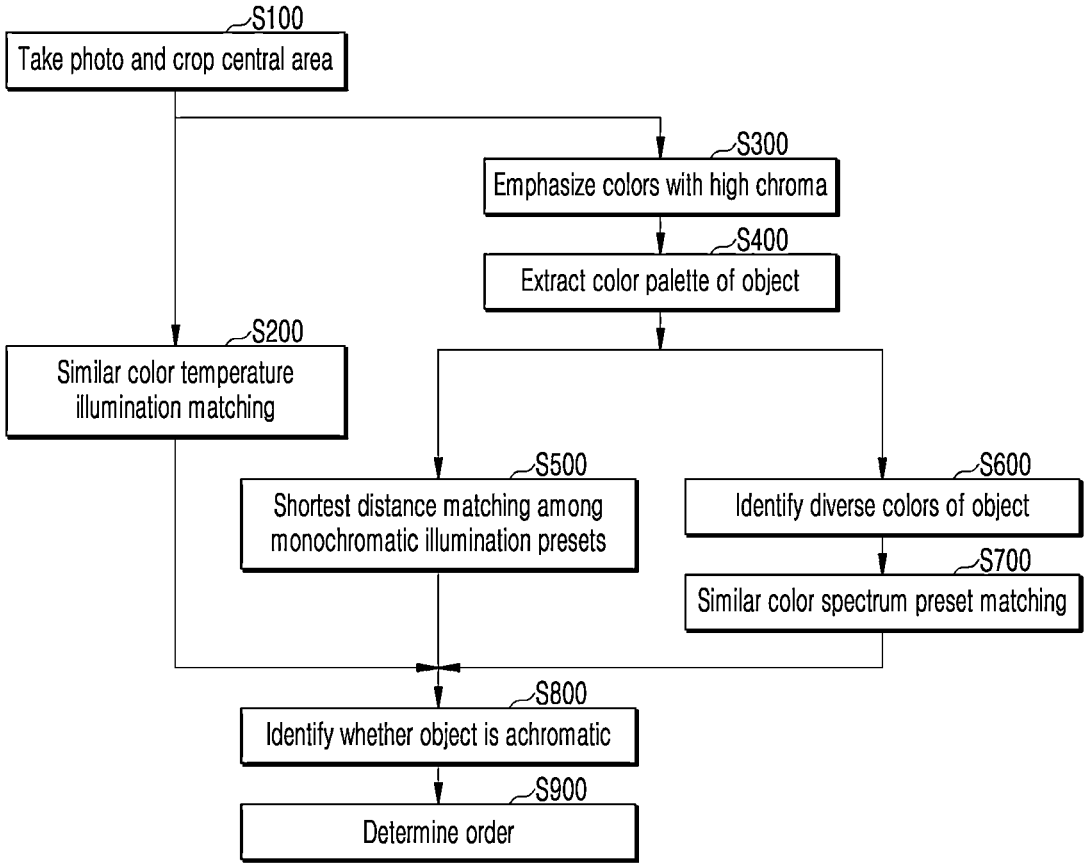
Figure 12:
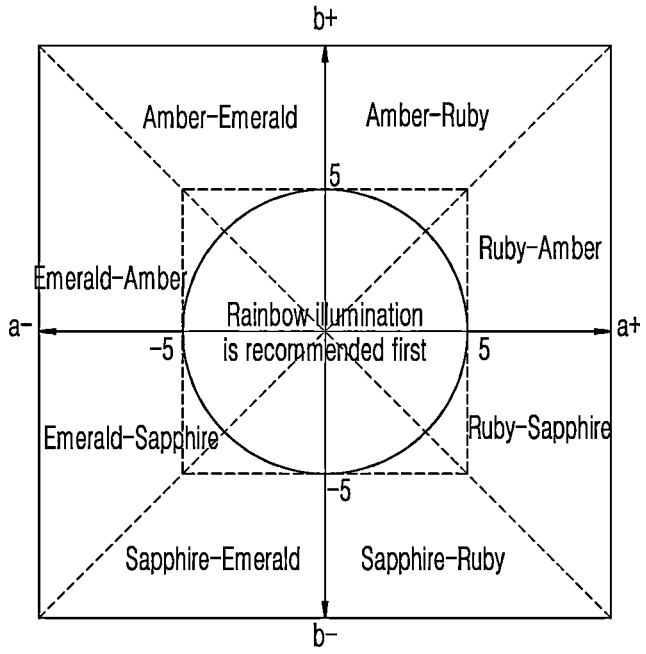
FIG. 12 is a drawing illustrating an example of processing according to an area on the CIE LAB color coordinates when recommending second illumination in a show case according to an embodiment of the present disclosure.
Figure 13:
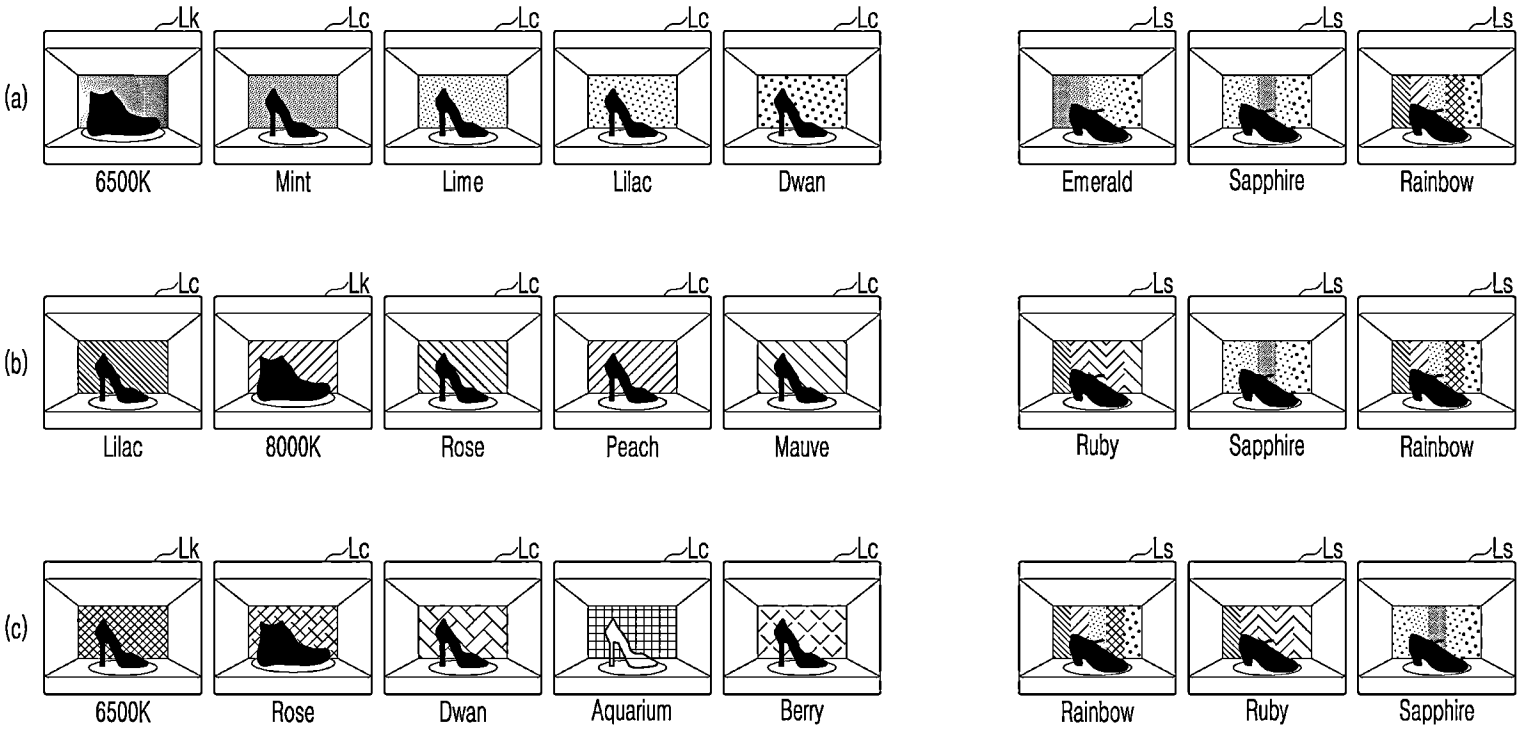
FIG. 13 is a drawing illustrating an example of a type of second illumination recommended to a user in a show case according to an embodiment of the present disclosure.

FIG. 9 is a drawing illustrating an example of the state in which a shoe image is input and second illumination 420 is recommended in a show case 1 according to an embodiment of the present disclosure. FIG. 10 and FIG. 11 are drawings illustrating an example of a process in which second illumination 420 is recommended in a show case 1 according to an embodiment of the present disclosure. FIG. 12 is a drawing illustrating an example of processing according to an area on the CIE LAB color coordinates when recommending second illumination 420 in a show case 1 according to an embodiment of the present disclosure. FIG. 13 is a drawing illustrating an example of a type of second illumination 420 recommended to a user in a show case 1 according to an embodiment of the present disclosure.

An algorithm for recommending the most suitable illumination to the user on the basis of shoes accommodated in the accommodation space 10 in a show case 1 according to an embodiment of the present disclosure will be described with reference to FIG. 9 to FIG. 13. In this case, the description will be made with reference to above-described FIG. 1 to FIG. 8*b* as well.

The show case 1 according to an embodiment of the present disclosure may include a body 100, a moving body 200, a blowing part 330, a first illumination 410, a second illumination 420, an input part 710, and a controller 600.

The body 100 is a part that forms part of an accommodation space 10, and may form a reference position for the moving body 200 that is moved to open and close the accommodation space 10.

The moving body 200 is a part that forms the accommodation space 10 together with the body 100 and includes a transparent window 210. That is, the moving body 200 is a part that forms the remaining part of the accommodation space 10, and the moving body 200 may move relative to the body 100 to open and close the accommodation space 10.

In particular, the moving body 200 may be configured to reciprocate relative to the body 100 between a first position and a second position in the forward and backward directions. In this case, the state in which the moving body 200 is at the first position may be defined as a closed state, and the state in which the moving body 200 is at the second position may be defined as an open state.

In the closed state of the show case 1, the accommodation space 10 may be sealed from the outside air. Therefore, when the accommodation space 10 is closed after the shoes are accommodated in the accommodation space 10, the shoes may be prevented from being exposed to the dust and moisture of the outside air.

The blowing part 330 is configured to circulate the air in the accommodation space 10, and may control the air condition (particularly, humidity) of the accommodation space 10 such that the shoes accommodated in the accommodation space 10 are placed in an appropriate environment.

In this case, a suction port 310 and a discharge port 320 may be formed in a part of the accommodation space 10, respectively. In addition, the air of the accommodation space 10 may be sucked into the air flow path 300 through the suction port 310 by the blowing part 330, and the air of the air flow path 300 may be discharged back to the accommodation space 10 through the discharge port 320 by the same. Therefore, the air forcibly blown by the blowing part 330 may circulate through the accommodation space 10 and the air flow path 300.

As described above, since the show case 1 according to the present embodiment accommodates the shoes in the accommodation space 10 formed by the body 100 and the moving body 200, switches to the closed state, and displays the shoes while controlling the state of the accommodation space 10 by circulating the air of the accommodation space 10 through the blowing part 330, the shoe display effect and the shoe management effect may be effectively implemented at the same time.

The first illumination 410 is a part that illuminates the shoes placed on the bottom of the accommodation space 10, and may intensively illuminate the shoes S placed on the upper surface of the turntable 230, thereby improving the display effect of shoes S.

The second illumination 420 is a part that illuminates the rear surface of the accommodation space 10, and may improve the visibility of the rear surface of the accommodation space 10 and provide a visual effect as a background for shoes. In addition, the second illumination 420 is configured to change the color of light, so that the aesthetics and colors of the rear surface of the accommodation space 10 may be varied.

As described above, in the show case 1 according to the present embodiment, the first illumination 410 may intensively illuminate the area where shoes are placed, and the second illumination 420 may illuminate the rear surface of the accommodation space 10, thereby maximizing the display effect of shoes and improving the interior effect of the space where the shoes are accommodated.

Meanwhile, when improving the visual effect of the shoes and accommodation space 10 through illumination as described above, it may be desirable to adjust the illumination to best match the accommodated shoes.

In particular, since the color of the light from the second illumination 420 may vary to change the aesthetics and colors of the rear surface of the accommodation space 10, it may be desirable to adjust the second illumination 420 such that it reflects the characteristics of the shoes accommodated.

In this case, it is not easy for the user to determine by himself which illumination best matches the shoes accommodated, so the show case 1 according to this embodiment may recommend the type of second illumination 420 that matches the accommodated shoes well to guide the user to select one of them.

In this regard, the input part 710 is a part to which an image of the shoe accommodated in the accommodation space 10 is input, and an image of the shoe may be input as basis data for analyzing the type of the second illumination 420 that matches the accommodated shoes well.

In addition, the controller 600 may recommend the type of second illumination 420 to the user on the basis of the image of shoe input to the input part 710. That is, the controller 600 may analyze the type of second illumination 420 that matches the accommodated shoes well on the basis of the input image of shoe as the basis data and then recommend the same to the user.

As described above, in the show case 1 according to the present embodiment, the controller 600 may recommend the second illumination 420 that matches the image of shoe well, which is input to the input part 710, to the user, thereby enabling the user to more easily select the type of second illumination 420 and improving the aesthetic sense through the second illumination 420 that reflects the characteristics of each shoe.

The show case 1 according to an embodiment of the present disclosure may further include a portable device 700 equipped with an input part 710 and capable of remote communication with the controller 600. In this case, the image of shoe may be captured by the portable device 700 and input to the input part 710, and the type of second illumination 420 recommended to the user by the controller 600 may be displayed through the portable device 700.

That is, as shown in FIG. 9, an image of the shoe accommodated in the show case 1 may be captured by the input part 710 provided in the portable device 700 while the user is carrying the portable device 700 separately configured from the show case 1.

In addition, the controller 600 may analyze the type of second illumination 420 that matches the accommodated shoe well on the basis of the image captured by the portable device 700, and, as illustrated in FIG. 9, display the type of second illumination 420 to be recommended through the portable device 700.

As described above, in the show case 1 according to the present embodiment, since the image of shoe is input through the portable device 700, and since the type of second illumination 420 to be recommended is displayed through the portable device 700 according thereto, it may be more convenient to input the image of shoe and identify the type of second illumination 420 to be recommended.

In the show case 1 according to an embodiment of the present disclosure, the portable device 700 may display a reference line 720 corresponding to the outer lines of the body 100 and the moving body 200 when capturing the image of shoe.

That is, as shown in FIGS. 9 and 10, when the user captures the image of shoe with the portable device 700, a reference line 720 corresponding to the outer shape of the show case 1 may be displayed on the screen of the portable device 700.

Therefore, the user may align the actual shape of the actual show case 1 to the reference line 720 of the portable device 700 and then capture the same. Through this, it is possible to induce the image of shoe to always be captured with a specific composition and a specific size when capturing the image using the portable device 700.

As described above, in the show case 1 according to the present embodiment, since the reference line 720 is displayed when capturing an image of shoe using the portable device 700, even if the photographers differ, the image may always be captured to have a similar composition, enabling more accurate input of the image for recommending the second illumination 420.

In the show case 1 according to an embodiment of the present disclosure, the controller 600 may control the first illumination 410 to illuminate the shoes when capturing an image of shoe with the portable device 700.

When capturing the image of shoe with the portable device 700, the image of shoe to be captured may vary depending on the capturing time or the surrounding environment. Therefore, there is a concern that the second illumination 420 is to be recommended according to the influences of the capturing time or the surrounding environment, instead of reflecting the unique characteristics of the shoes.

Therefore, when capturing a shoe image through the portable device 700, it may be desirable to have the first illumination 410 illuminate the shoes so that the accommodation space 10 remains in a relatively constant state even if the capturing time or surrounding environment changes.

As described above, in the show case 1 according to the present embodiment, it is possible to more accurately input an image for recommending the second illumination 420 by always capturing images in a similar state even if the capturing time and surrounding environment of the shoe image varies.

In the show case 1 according to an embodiment of the present disclosure, the image of shoe input through the input part 710 may be captured through the portable device 700 and then a dummy area Ad may be removed therefrom (S100).

As described above, even if the image of shoe is captured with the reference line 720 displayed, a dummy area Ad, which is not related to the shoe, may be produced depending on the size of the accommodated shoe or the like.

Since this dummy area Ad is not related to the basis data for analyzing the type of second illumination 420 that matches the accommodated shoes well, it may be desirable to analyze the type of second illumination 420 after excluding the same.

To this end, the accommodation space 10 may be divided into a plurality of horizontal sections and a plurality of vertical sections, and the sections other than a specific section may be regarded as dummy areas Ad. Alternatively, the dummy areas Ad may be removed using a computer vision technology including YOLOv5 or a technology for segmenting the area of an object in a photographed image.

Alternatively, the dummy areas Ad may be removed using various technologies and methods as needed, such as having the user directly cut out the dummy areas Ad from the captured shoe image on the portable device 700.

As described above, in the show case 1 according to the present embodiment, since the dummy areas Ad are removed when capturing the image of shoe using the portable device 700, a portion of the image, which does not need to be reflected when recommending the second illumination 420, may be excluded, so that the recommendation of the second illumination 420 may be performed more effectively.

Meanwhile, the image of shoe from which the dummy areas Ad are removed may be subjected to white balance such that the characteristics of the shoes may be reflected more accurately as the basis data.

In the show case 1 according to an embodiment of the present disclosure, the second illumination 420 may be configured to change to any one of a plurality of preset illuminations that are set in advance. In this case, the controller 600 may recommend at least one of similar color temperature illumination Lk, similar monochromatic illumination Lc, and similar spectrum illumination Ls for the image of shoe, among the preset illuminations, to the user (S200, S500, and S700).

The preset illuminations indicate illuminations are preset to a specific state in which the second illumination 420 may change during the design and/or manufacturing of the show case 1.

Among them, the similar color temperature illumination Lk may be preset illumination having the color temperature most similar to the image of shoe. In addition, the similar monochromatic illumination Lc may be preset illumination having the color most similar to the image of shoe. In addition, the similar spectrum illumination Ls may be illumination in a spectrum state having the color most similar to the image of shoe.

As described above, since the show case 1 according to the present embodiment recommends at least one of the similar color temperature illumination Lk, the similar monochromatic illumination Lc, and the similar spectrum illumination Ls among the preset illuminations set in advance to the user, it is possible to make recommendations reflecting the accommodated shoes in various ways, thereby increasing the user's utilization of the second illumination 420.

In the show case 1 according to an embodiment of the present disclosure, the similar color temperature illumination Lk may be preset illumination to be recommended according to the average color temperature of pixels whose brightness (value) is within the upper setting range in the image of shoe.

As one of the methods of selecting the type of second illumination 420 that matches the accommodated shoes well, the brightest pixel may be extracted separately from the captured image of shoe and analyzed to analyze which color temperature of preset illumination matches the same from among the preset illuminations imitating a standard light source.

In this case, the values of the pixels of the shoe image may be converted into HSV units so that pixels whose brightness is within the upper setting range (for example, the upper 10%) may be separately extracted. Then, the average color temperature of the extracted pixels may be calculated to recommend the closest preset illumination as the similar color temperature illumination Lk.

To this end, color conversion technology may be used, and various functions included in Colour Science for Python may be used for calculation, but the present disclosure is not necessarily limited thereto, and various technologies and methods may be utilized as needed.

As described above, in the show case 1 according to the present embodiment, since the similar color temperature illumination Lk that goes well with pixels having relatively high brightness in the image of shoe is recommended, the second illumination 420 having the most similar color temperature to the image of shoe may be recommended.

In the show case 1 according to an embodiment of the present disclosure, the similar monochromatic illumination Lc may be preset illumination to be recommended according to the color with the highest proportion in the color palette Cp that reflects pixels with relatively high chroma in the image of shoe.

In this case, the color palette Cp indicates the result in which the primary colors constituting the image of shoe are derived into a plurality of clusters, as illustrated in FIG. 10.

As another method of selecting the type of second illumination 420 that matches the accommodated shoe well, the color with high chroma may be emphasized and analyzed in the captured image of shoe to analyze which color of preset illumination matches the shoe well, among the preset illuminations.

In this regard, it is widely known that people tend to place more weight on the color with higher chroma than on the actual color when viewing the object, relying on cognitive memory colors. Therefore, a method of analyzing colors with higher chroma to be emphasized, among the colors of the photographed shoe image, and then recommending the same as the similar monochromatic illumination Lc may be importantly considered.

As described above, in the show case 1 according to the present embodiment, since the similar monochromatic illumination Lc that goes well with the pixels with higher chroma in the shoe image is recommended, the second illumination 420 may be recommended to reflect the tendency to place more weight on colors with higher chroma than on actual colors when recognizing objects.

In the show case 1 according to an embodiment of the present disclosure, the color palette Cp may be obtained by amplifying the number of pixels in the image of shoe whose value $((a^*)2+(b^*)2)½$ is greater than or equal to a first setting value on the three-dimensional coordinates defined by L*, a*, and b*, which are color spaces for color recognition (S300), and then deriving a plurality of clusters therefrom using a clustering algorithm (S400).

In this case, the three-dimensional coordinates defined by L*, a*, and b*, which are color spaces for color recognition, may be the LAB color coordinates of the International Commission on Illumination (CIE). In addition, L* represents brightness information and indicates 0 (black) to 100 (white). a* represents minus a (green) to plus a (red). b* represents minus b (blue) to plus b (yellow).

As described above, in order to emphasize the color with high chroma among the colors in the captured shoe image, the values of the pixels of the shoe image may be converted to Lab units, and the number of pixels whose value $((a^*)2+(b^*)2)½$ is greater than or equal to the first setting value (e.g., 35) may be amplified (e.g., increased by 30 times).

To this end, although the color conversion function included in Colour Science for Python may be used, the present disclosure is not necessarily limited thereto, and various technologies and methods may be utilized as needed.

In addition, in order to analyze what colors constitute the captured shoe image, a color palette Cp including a plurality of (e.g., 12) clusters may be derived from the color values of the respective pixels calculated above using a clustering algorithm.

To this end, although K-means clustering, Fuzzy C-means, etc. may be utilized, the present disclosure is not necessarily limited thereto, and various technologies and methods may be utilized as needed.

As described above, since the show case 1 according to the present embodiment utilizes the color palette Cp obtained by amplifying the pixels with higher chroma in the image of shoe and classifying the same into clusters, the second illumination 420 may be recommended by utilizing an analysis that emphasizes the color with higher chroma.

In the show case 1 according to an embodiment of the present disclosure, the controller 600 may recommend the similar monochromatic illumination Lc in the order of the shortest Euclidean distance from the color with the highest proportion in the color palette Cp derived as a plurality of clusters.

In this case, when calculating the distance between two points, the Euclidean distance is obtained by representing two points as coordinates, adding the squares of the differences of corresponding components, and then calculating the square root thereof.

Therefore, the color with the highest proportion may be set as a dominant color in the color palette Cp derived as described above, and the Euclidean distance between the Lab value of the dominant color and the Lab value of the preset illumination may be calculated, so that the similar monochromatic illumination Lc may be recommended in ascending order from the shortest distance.

As described above, in the show case 1 according to the present embodiment, since the similar monochromatic illumination Lc is recommended in the order of going well with the color with the highest proportion in the color palette Cp derived as a plurality of clusters, the recommendation order of the second illumination 420 may be determined in a similar order to the color of the shoe.

In the show case 1 according to an embodiment of the present disclosure, the similar spectrum illumination Ls may be preset illumination in a spectrum state to be recommended in the order of the shortest Euclidean distance from the color with the highest proportion in the color palette Cp.

In this case, the spectrum state indicates the state in which colors are distributed and arranged in the order of wavelengths, as illustrated in FIG. 10.

Another method of selecting the type of second illumination 420 that matches the accommodated shoes well is to analyze which color of preset illumination matches well, among the preset illumination, and to recommend such a color in a spectrum state rather than a monochromatic state.

That is, a method of recommending the most similar color based on the primary colors constituting the image of shoe as similar spectrum illumination Ls in the spectrum state may also be importantly considered.

As described above, in the show case 1 according to the present embodiment, since the similar spectrum illumination Ls in the spectrum state is recommended in the order of going well with the color with the highest proportion in the color palette Cp derived as a plurality of clusters, the recommendation order of the second illumination 420 in the spectrum state may be determined in a similar order to the color of the shoe.

In the show case 1 according to an embodiment of the present disclosure, if the maximum value of the Euclidean distances between three colors with relatively high distribution in the color palette Cp is greater than or equal to a second setting value, the colors included in the image of shoe may be considered diverse (S600).

When recommending the second illumination 420 that reflects the characteristics of the accommodated shoes, although a color in a single color or spectrum state may be recommended on the basis of the primary colors as described above, if the image of shoe is configured in various colors, instead of a color in a specific family, it may also be an important consideration.

This is due to the fact that, in the case where the accommodated shoe has various colors, recommending a color in a specific family close to the primary colors may result in not reflecting the characteristics of the shoe.

Accordingly, the Euclidean distances between the respective colors may be calculated through values a* and b* of three colors with the highest distribution in the color palette Cp extracted as described above. In addition, if the maximum value of the calculated distances is greater than the second setting value (e.g., 35), the shoe may be regarded as having various colors rather than a color in a specific family.

That is, if the maximum value of the calculated distances is greater than the second setting value (e.g., 35), it may indicate that at least two of the three colors with the highest distribution in the extracted color palette Cp are far apart from each other on the color coordinates, so it be more appropriate to treat the image of shoe as having various colors rather than a color in a specific family.

As described above, since the show case 1 according to the present embodiment determines whether or not the shoe image has diverse colors through the Euclidean distances between three colors with relatively high distribution in the color palette Cp derived as a plurality of clusters, the second illumination 420 may be recommended by utilizing an analysis reflecting the case where the shoe has various colors.

In the show case 1 according to an embodiment of the present disclosure, the controller 600 may preferentially recommend the rainbow-typed similar spectrum illumination Ls if the colors included in the image of shoe are considered diverse or if the absolute values of a* and b* of the color with the highest proportion in the color palette Cp are both smaller than a third setting value.

In this case, the rainbow type indicates the type in which the similar spectrum illumination Ls is configured as a plurality of colors between red and purple, which are dispersed and arranged by the dispersion of visible light, instead of as a color in a specific family.

As described above, if the accommodated shoes are configured in various colors, it may be desirable to recommend the rainbow-typed similar spectrum illumination Ls, instead of recommending a color in a specific family close to the primary color.

In addition, as shown in FIG. 12, if the absolute values of a* and b* of the color with the highest proportion in the color palette Cp are both smaller than the third setting value (e.g., 5), the property of the primary color does not belong to a specific color family and is not distinct, so in this case as well, it may be desirable to recommend the rainbow-typed similar spectrum illumination Ls, instead of recommending a color in a specific family.

As described above, in the show case 1 according to the present embodiment, if the shoe image has various colors or if the property of the color with the highest proportion in the color palette Cp derived as a plurality of clusters is not distinct, the rainbow-typed similar spectrum illumination Ls is preferentially recommended, so the second illumination 420 may be recommended to reflect the case where there is no bias toward a specific color.

In the show case 1 according to an embodiment of the present disclosure, if the value of ((a*)2+(b*)2)½ of the color with the highest proportion in the color palette Cp is less than or equal to a fourth setting value, the shoe image may be regarded as achromatic (S800).

When recommending the second illumination 420 reflecting the characteristics of the accommodated shoes, if the image of shoe is achromatic, it may also be an important factor to consider.

This is due to the fact that, if the accommodated shoes are achromatic, it may not go well with the second illumination 420 reflecting colors.

Accordingly, the primary color may be converted to a Lab value to calculate the value of ((a*)2+(b*)2)½ of the corresponding color. In addition, as described above, since the pixels whose calculated values are higher than the first setting value (e.g., 35) are relatively dark colors, they may be amplified more than other pixels. Therefore, such colors may be likely to be output as primary colors when extracting the color palette Cp. Nevertheless, if the value of ((a*)2+(b*)2)½ of the primary color is lower than the fourth setting value (e.g., 35), the corresponding image of shoe may be regarded as achromatic.

As described above, since the show case 1 according to the present embodiment determines whether or not the image of shoe is achromatic through the property of the color with the highest proportion in the color palette Cp derived as a plurality of clusters, the second illumination 420 may be recommended by utilizing an analysis reflecting the case where the shoe is achromatic.

In a show case 1 according to an embodiment of the present disclosure, the controller 600 may preferentially recommend similar color temperature illumination Lk over similar monochromatic illumination Lc if the image of shoe is considered to be achromatic (S900).

As described above, if the accommodated shoes are configured to be achromatic, the second illumination 420 reflecting colors may not go well with it, so it may be preferable to preferentially recommend similar color temperature illumination Lk over similar monochromatic illumination Lc.

On the other hand, if the accommodated shoes are configured to be chromatic, the second illumination 420 may be recommended by presenting similar monochromatic illumination Lc closest to the primary color and then presenting similar color temperature illumination Lk.

As described above, in the show case 1 according to the present embodiment, since the similar color temperature illumination Lk is preferentially recommended over the similar monochromatic illumination Lc when the image of shoe is achromatic, it is possible to induce the selection of second illumination 420 with the closest color temperature to the shoe image, instead of matching the color of the shoe image.

In the show case 1 according to an embodiment of the present disclosure, the controller 600 may recommend similar spectrum illumination Ls, regardless of the priority between the similar monochromatic illumination Lc and the similar color temperature illumination Lk.

As described above, depending on whether or not the image of the accommodated shoes is achromatic, one of the similar color temperature illumination Lk and the similar monochromatic illumination Lc may be preferentially recommended.

However, apart from that, there may be cases where the similar spectrum illumination Ls reflects the characteristics of the shoe better, such as when the image of the accommodated shoes does not have a distinct color in a specific family.

Therefore, in order to provide more diverse choices to the user, the second illumination 420 may be recommended by presenting the similar spectrum illumination Ls separately from the similar monochromatic illumination Lc and the similar color temperature illumination Lk.

As described above, since the show case 1 according to the present embodiment recommends the similar spectrum illumination Ls independently of the priority between the similar monochromatic illumination Lc and the similar color temperature illumination Lk to be recommended, it is possible to provide more diverse choices to the user who wishes to select the type of second illumination 420.

The recommendation order of the second illumination 420 described above will be described by way of on the basis of the second illumination 420 illustrated in FIG. 13 as follows.

First, in the case of (a) of FIG. 13, the similar color temperature illumination Lk is recommended first, and then the similar monochromatic illumination Lc may be sequentially recommended. In addition, the similar spectrum illumination Ls may be sequentially recommended, regardless of the above.

In addition, in the case of (b) of FIG. 13, the similar monochromatic illumination Lc closest to the primary color may be recommended first, and then the similar color temperature illumination Lk and the remaining similar monochromatic illumination Lc may be sequentially recommended. In addition, the similar spectrum illumination Ls may be sequentially recommended, regardless of the above.

In addition, in the case of (c) of FIG. 13, the similar color temperature illumination Lk may be recommended first, and then the similar monochromatic illumination Lc may be sequentially recommended. In addition, the similar spectrum illumination Ls is sequentially recommended, regardless of the above, such that the rainbow-typed similar spectrum illumination Ls is preferentially recommended.

Although the example of second illumination 420 to be recommended has been described above, the present disclosure is not necessarily limited to those shown in FIG. 13, and various combinations of second illuminations 420 may be recommended depending on the characteristics of the accommodated shoes and the user's preference.

Hereinabove, a specific embodiment of the present disclosure is described and illustrated, but the present invention is not limited to the disclosed embodiment, and it may be appreciated by those skilled in the art that the embodiment may be variously modified and transformed to another specific embodiment without departing from the spirit and the scope of the present invention. Therefore, the scope of the present disclosure will not be defined by the described embodiment, but defined by the technical spirit disclosed in the claims.

INDUSTRIAL APPLICABILITY

According to at least one of the embodiments of the present disclosure, since the show case is configured to accommodate an object in the accommodation space formed by the body and the moving body and then switch to a closed state to display the object, and at the same time, configured to circulate the air in the accommodation space through the blowing part to control the state of the accommodation space, both the object display effect and the object management effect may be effectively implemented.

In addition, according to at least one of the embodiments of the present disclosure, since the first illumination intensively illuminates the area where the object is placed and since the second illumination illuminates the rear surface of the accommodation space, it is possible to improve the interior effect of the space where the object is accommodated while maximizing the display effect of the object.

In addition, according to at least one of the embodiments of the present disclosure, since the controller recommends the second illumination that best matches the object image input to the input part to the user, the user may select the type of second illumination more easily and the aesthetic sense may be improved through the second illumination that reflects the characteristics of each object.

In addition, according to at least one of the embodiments of the present disclosure, since the object image is input through the portable device and since the type of second illumination to be recommended is displayed through the portable device according thereto, it may be more convenient to input the object image and identify the type of second illumination to be recommended.

In addition, according to at least one of the embodiments of the present disclosure, since the reference line is displayed when capturing the object image through the portable device, even if the photographers differ, the image may always be captured to have a similar composition, enabling more accurate input of the image for recommending the second illumination.

In addition, according to at least one of the embodiments of the present disclosure, it is possible to more accurately input an image for recommending the second illumination by always capturing images in a similar state even if the capturing time and surrounding environment of the object image varies.

In addition, according to at least one of the embodiments of the present disclosure, since the dummy areas are removed when capturing the object image using the portable device, a portion of the image, which does not need to be reflected when recommending the second illumination, may be excluded, so that the recommendation of the second illumination may be performed more effectively.

In addition, according to at least one of the embodiments of the present disclosure, since at least one of the similar color temperature illumination, the similar monochromatic illumination, and the similar spectrum illumination is recommended from among the preset illuminations to the user, recommendation may be performed to reflect the accommodated object in various ways, thereby increasing the user's utilization of the second illumination.

In addition, according to at least one of the embodiments of the present disclosure, since the similar color temperature illumination that goes well with pixels with relatively high brightness in the object image is recommended, the second illumination having the most similar color temperature to the object image may be recommended.

In addition, according to at least one of the embodiments of the present disclosure, since the similar monochromatic illumination that goes well with pixels with relatively high chroma in the object image is recommended, it is possible to recommend the second illumination reflecting the tendency to place more weight on colors with higher chroma than on actual colors when recognizing an object.

In addition, according to at least one of the embodiments of the present disclosure, since the color palette obtained by amplifying the pixels with higher chroma in the object image and classifying the same into clusters is utilized, the second illumination may be recommended by utilizing an analysis that emphasizes the color with higher chroma.

In addition, according to at least one of the embodiments of the present disclosure, since the similar monochromatic illumination is recommended in the order of going well with the color with the highest proportion in the color palette derived as a plurality of clusters, the recommendation order of the second illumination may be determined in a similar order to the color of the object.

In addition, according to at least one of the embodiments of the present disclosure, since the similar spectrum illumination in the spectrum state is recommended in the order of going well with the color with the highest proportion in the color palette derived as a plurality of clusters, the recommendation order of the second illumination in the spectrum state may be determined in a similar order to the color of the object.

In addition, according to at least one of the embodiments of the present disclosure, since the show case is configured to determine whether or not the object image has diverse colors through the Euclidean distances between three colors with relatively high distribution in the color palette derived as a plurality of clusters, the second illumination may be recommended by utilizing an analysis reflecting the case where the object has various colors.

In addition, according to at least one of the embodiments of the present disclosure, if the object image has various colors or if the property of the color with the highest proportion in the color palette derived as a plurality of clusters is not distinct, the rainbow-typed similar spectrum illumination is preferentially recommended, so the second illumination may be recommended to reflect the case where there is no bias toward a specific color.

In addition, according to at least one of the embodiments of the present disclosure, since the show case is configured to determine whether or not the object image is achromatic through the property of the color with the highest proportion in the color palette derived as a plurality of clusters, the second illumination may be recommended by utilizing an analysis reflecting the case where the object is achromatic.

In addition, according to at least one of the embodiments of the present disclosure, since the similar color temperature illumination is preferentially recommended over the similar monochromatic illumination when the object image is achromatic, it is possible to induce the selection of second illumination with the closest color temperature to the object image, instead of matching the color of the object image.

In addition, according to at least one of the embodiments of the present disclosure, since the similar spectrum illumination is recommended independently of the priority between the similar monochromatic illumination and the similar color temperature illumination to be recommended, it is possible to provide more diverse choices to the user who wishes to select the type of second illumination.

The invention claimed is:

1. A show case having an accommodation space in which an object is accommodated, the show case comprising:

a body;

a moving body configured to form the accommodation space together with the body and comprising a transparent window;

a blowing part configured to circulate air in the accommodation space;

a first illumination configured to illuminate an object placed on a bottom surface of the accommodation space;

a second illumination configured to illuminate a rear surface of the accommodation space;

an input part to which an image of the object accommodated in the accommodation space is input; and a controller configured to recommend a type of second illumination to a user depending on the image input to the input part.

2. The show case according to claim 1, further comprising a portable device having the input part and capable of remote communication with the controller, wherein the image is captured by the portable device and input to the input part, and wherein the type of second illumination recommended to the user by the controller is displayed on the portable device.

3. The show case according to claim 2, wherein the portable device displays a reference line corresponding to outer lines of the body and the moving body when capturing the image.

4. The show case according to claim 3, wherein the controller is configured to control the first illumination to illuminate the object when capturing the image through the portable device.

5. The show case according to claim 4, wherein the image input through the input part is captured through the portable device and then dummy areas thereof are removed.

6. The show case according to claim 1, wherein the second illumination is configured to change to any one of a plurality of preset illuminations that are set in advance, and wherein the controller is configured to recommend at least one of similar color temperature illumination, similar monochromatic illumination, and similar spectrum illumination for the image from among the preset illuminations to the user.

7. The show case according to claim 6, wherein the similar color temperature illumination is the preset illumination to be recommended according to an average color temperature of pixels whose brightness (value) is within an upper setting range in the image.

8. The show case according to claim 7, wherein the similar monochromatic illumination is the preset illumination to be recommended according to a color with a highest proportion in a color palette reflecting pixels whose chroma is relatively high in the image.

9. The show case according to claim 8, wherein the color palette is obtained by amplifying a number of pixels whose value $((a^*)^2+(b^*)^2)^{1/2}$ is greater than or equal to a first setting value in the image on three-dimensional coordinates defined by L*, a*, and b*, which are color spaces for color recognition, and then deriving a plurality of clusters therefrom using a clustering algorithm.

10. The show case according to claim 9, wherein the controller is configured to recommend the similar monochromatic illumination in order of a shortest Euclidean distance from the color with the highest proportion in the color palette derived as a plurality of clusters.

11. The show case according to claim 10, wherein the similar spectrum illumination is the preset illumination in a spectrum state to be recommended in order of the shortest Euclidean distance from the color with the highest proportion in the color palette.

12. The show case according to claim 11, wherein, if the maximum value of the Euclidean distances between three colors with relatively high distribution in the color palette is greater than or equal to a second setting value, the colors included in the image are considered diverse.

13. The show case according to claim 12, wherein the controller is configured to preferentially recommend rainbow-typed similar spectrum illumination if the colors included in the image are considered diverse or if an absolute values of a* and b* of the color with the highest proportion in the color palette are both smaller than a third setting value.

14. The show case according to claim 13, wherein, if the value $((a^*)^2+(b^*)^2)^{1/2}$ of the color with the highest proportion in the color palette is less than or equal to a fourth setting value, the image is regarded as achromatic.

15. The show case according to claim 14, wherein the controller is configured to preferentially recommend the similar color temperature illumination over the similar monochromatic illumination if the image is regarded as achromatic.

16. The show case according to claim 15, wherein the controller is configured to recommend the similar spectrum illumination, regardless of the priority between the similar monochromatic illumination and the similar color temperature illumination.

* * * * *